US005269095A

United States Patent [19]

Helfman et al.

[11] Patent Number: 5,269,095

[45] Date of Patent: Dec. 14, 1993

[54] PLANTER MOUNTING ASSEMBLY

[75] Inventors: Barbara Helfman, Middletown; Paul G. Whitehead, West Chester, both of Ohio

[73] Assignee: Topsiders, Inc., Cincinnati, Ohio

[21] Appl. No.: 728,582

[22] Filed: Jul. 11, 1991

[51] Int. Cl.[5] ..... A47G 7/00

[52] U.S. Cl. ..... 47/66; 47/39

[58] Field of Search ..... 47/66, 68, 39, 40, 71; 248/311.2, 214; 220/628, 630, 636; 211/88

[56] References Cited

U.S. PATENT DOCUMENTS

| | | | |
|---|---|---|---|
| 296,028 | 4/1884 | Martin | 47/71 |
| 996,137 | 6/1911 | Praeger | 220/628 |
| 1,353,853 | 9/1920 | Sandberg . | |
| 1,852,650 | 4/1932 | Halberstadter . | |
| 1,955,476 | 4/1934 | Torgersen . | |
| 3,107,028 | 10/1963 | De Roberts | 220/630 |
| 4,559,738 | 12/1985 | Helfman . | |
| 4,698,936 | 10/1987 | Helfman . | |
| 4,887,731 | 12/1989 | Pett | 220/630 |

FOREIGN PATENT DOCUMENTS

| | | | |
|---|---|---|---|
| 348814 | 3/1979 | Austria . | |
| 8126467 | 5/1977 | Fed. Rep. of Germany . | |
| 7635182 | 12/1977 | Fed. Rep. of Germany . | |
| 7723462 | 12/1977 | Fed. Rep. of Germany . | |
| 2920155 | 11/1980 | Fed. Rep. of Germany . | |
| 2082881 | 12/1971 | France | 220/628 |
| 2340073 | 3/1982 | France . | |
| 2510349 | 2/1983 | France . | |
| 2520218 | 7/1983 | France . | |
| 627921 | 8/1949 | United Kingdom | 220/636 |

*Primary Examiner*—Henry E. Raduazo
*Attorney, Agent, or Firm*—Frost & Jacobs

[57] ABSTRACT

A mounting assembly for affixing a planter to a horizontal or vertical surface such as the top or side of a deck, balcony or porch railing, iron railing, vertical wall and the like. The planter has a bottom, a surrounding wall extending upwardly from the bottom, and an open top. The bottom is so configured as to accommodate at least one vertically oriented bolt. The at least one bolt is isolated from the interior of the planter. At least one bracket is attachable to the planter by the at least one bolt. The at least one bracket is also attachable to the railing or wall by appropriate fastening means. In a preferred embodiment the planter bottom is provided with at least one upstanding socket for the at least one bolt. The socket has a central vertical bore with an open bottom end and a closed top end. An internally threaded bushing is fixed in the socket bore to be threadedly engaged by the at least one bolt.

27 Claims, 19 Drawing Sheets

PLANTER MOUNTING ASSEMBLY

TECHNICAL FIELD

The invention relates to a mounting assembly for a planter, and more particularly to a mounting assembly for affixing a planter to a horizontal or vertical surface such as the top or side of deck, balcony, or porch railings, iron railings, walls and the like.

BACKGROUND ART

In recent years there has been renewed interest in the use of plants and flowers for their color and decorative qualities. For example, U.S. Pat. Nos. 4,559,738 and 4,698,936 teach planters and means for attaching the planters to the top or sides of wall partitions such as are frequently encountered in open plan offices.

Another excellent location for planters is on the top or sides of various types of railings, both indoors and outdoors. In recent years there has been an increased use of railings, as for example on the balconies of high rise condominiums, on the decks of houses, on the decks of above-ground pools, and so on. To date, however, little has been done to provide simple, safe and secure means for affixing a planter on top of or alongside the top rail of a railing structure.

The primary object of the present invention is to provide planter mounting assemblies enabling the location of a planter on top of or alongside the top rail of a railing, whether the railing be made of wood, metal or the like. The mounting assemblies of the present invention are extremely simple, easy and inexpensive to manufacture and quite easy to install. Once installed, the planter is firmly and safely mounted in association with the railing and cannot be inadvertently dislodged therefrom. On the other hand, the mounting assemblies are such that the planters can be easily removed from the railings for purposes of railing maintenance such as repair or painting. In some instances, the same mounting assembly may be used to mount a planter on various types and sizes of top rail.

DISCLOSURE OF THE INVENTION

According to the invention, mounting assemblies are provided for affixing a planter to a horizontal or vertical surface such as the top or side of deck, balcony or porch railings, iron railings, walls and the like. The planter comprises an elongated generally rectangular structure having a bottom, side and end walls, and an open top. The planter may be made of any appropriate material such as metal, plastic, synthetic resin or wood. The bottom of the planter is so configured as to accommodate at least one internally threaded, vertically oriented bushing. Means are provided to seal the bushing from water and soil contained within the planter.

At least one bracket is attachable to the planter by at least one bolt threadedly engageable in the at least one bushing. The at least one bracket is attachable to the railing or wall by appropriate fastening means.

In one embodiment, the planter is provided with a pair of bushings near each end of the planter. A pair of identical angle brackets is provided for each pair of bushings. Each angle bracket is affixed to its respective bushing by a bolt. Each angle bracket has one leg underlying the planter bottom and a second leg depending downwardly along the side of the top rail. The downwardly depending portions of the angle brackets are affixed to the sides of the top rail by any appropriate fastener means. By properly orienting the angle brackets, they may be used to attach the planter to various sizes and types of top rails.

In instances where the top rails are metal, the planter is again provided with two pairs of bushings. Each pair of bushings is adapted to receive bolts supporting a plate-like bracket. When the bolts are appropriately tightened, the bottom of the planter will engage the top surface of the top rail and the plate-like bracket will engage the bottom surface of the top rail with a clamping action.

In another embodiment, the planter is provided with two pairs of bushings, each pair located near an end of the planter. A first bracket is attached to each pair of bushings by bolt means. Each first bracket has a central depressed portion spaced from the bottom of the planter. A second bracket is provided for each first bracket. Each second bracket is affixed to the top surface of the top rail and has a forwardly extending tongue spaced upwardly from the top surface of the top rail. The tongue portion of each of the second brackets is engageable between its respective first bracket and the bottom of the planter, to firmly attach the planter to the top rail.

Two embodiments of bracket means are set forth for attaching the planter alongside the top rail. One of these bracket means can also be used to attach the planter to a vertical wall such as the wall of a house beneath a window or the like.

In yet another embodiment, the planter is provided with a single bushing near each of its ends. A bracket is affixed to the bottom of the planter at each bushing, by means of a bolt passing through the bracket and threadedly engaging the bushing. Each bracket has downwardly depending end portions adapted to lie along the sides of the top rail and to be affixed to the sides of the top rail by appropriate fastening means.

In a final embodiment, the planter is provided with a single bushing located at the intersection of the transverse and longitudinal centerlines of the planter bottom. A bolt is threadedly engaged in the bushing The bolt has an enlarged diameter shank portion beneath its head which terminates in an annular shoulder which abuts the bushing. The head and the enlarged diameter shank portion of the bolt constitute a headed stand-off. A single bracket is provided and is affixed to the top surface of the top rail. The single bracket has a forwardly extending tongue portion spaced upwardly from the top surface of the top rail. The tongue portion is notched, or is provided with a keyhole slot and is adapted to engage the enlarged shank portion of the bolt adjacent the bolt head. The bottom of the planter is provided with a pair of short, parallel guide rails which lie to either side of the tongue portion of the bracket when the tongue portion is engaged with the bolt. The guide rails preclude rotational movement of the planter about the bolt, when the bolt is engaged by the tongue portion of the bracket.

DETAILED DESCRIPTION OF THE INVENTION

Figure 1:
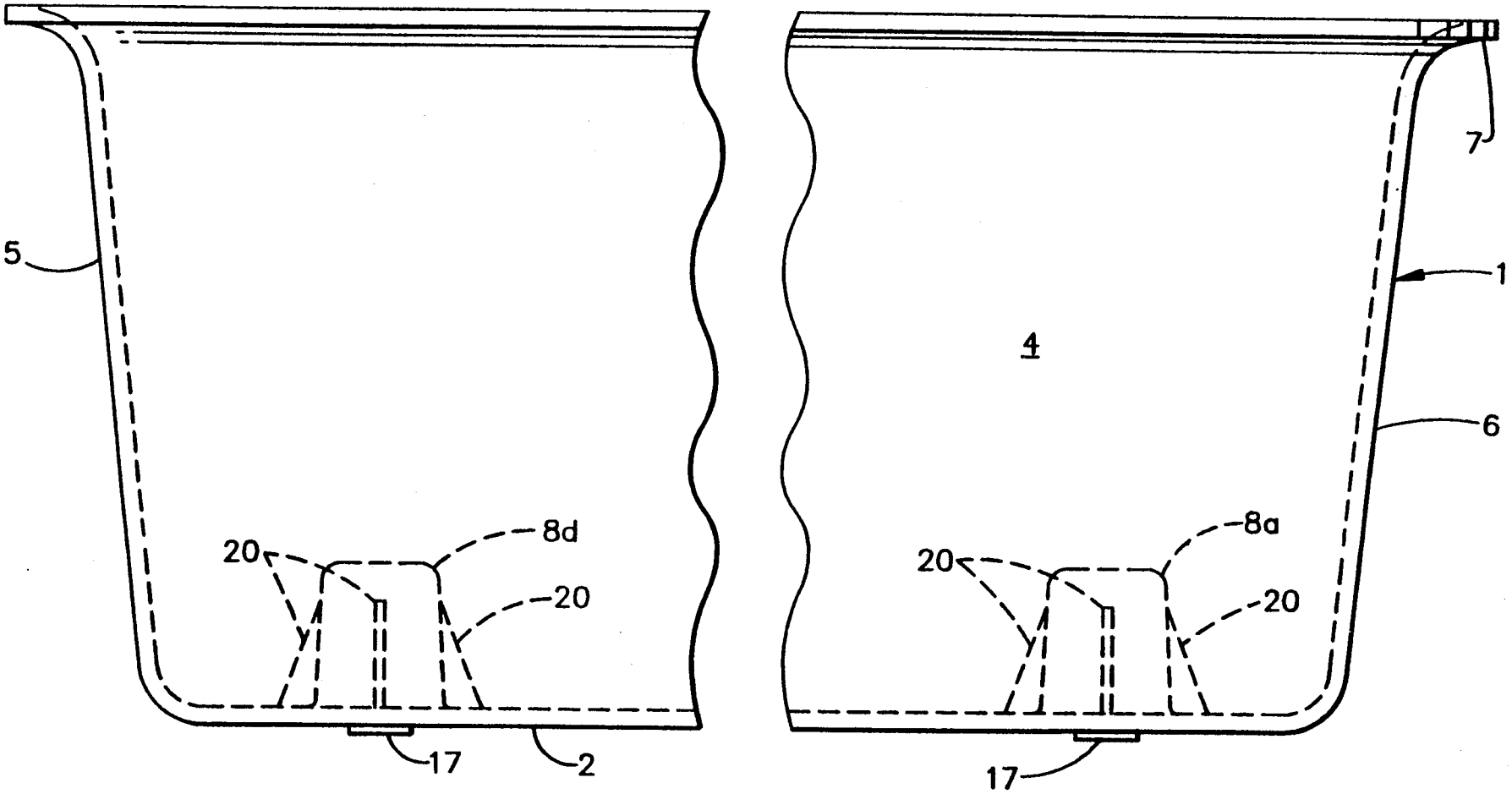
FIG. 1 is a fragmentary elevational view of an exemplary planter of the present invention.
Figure 2:
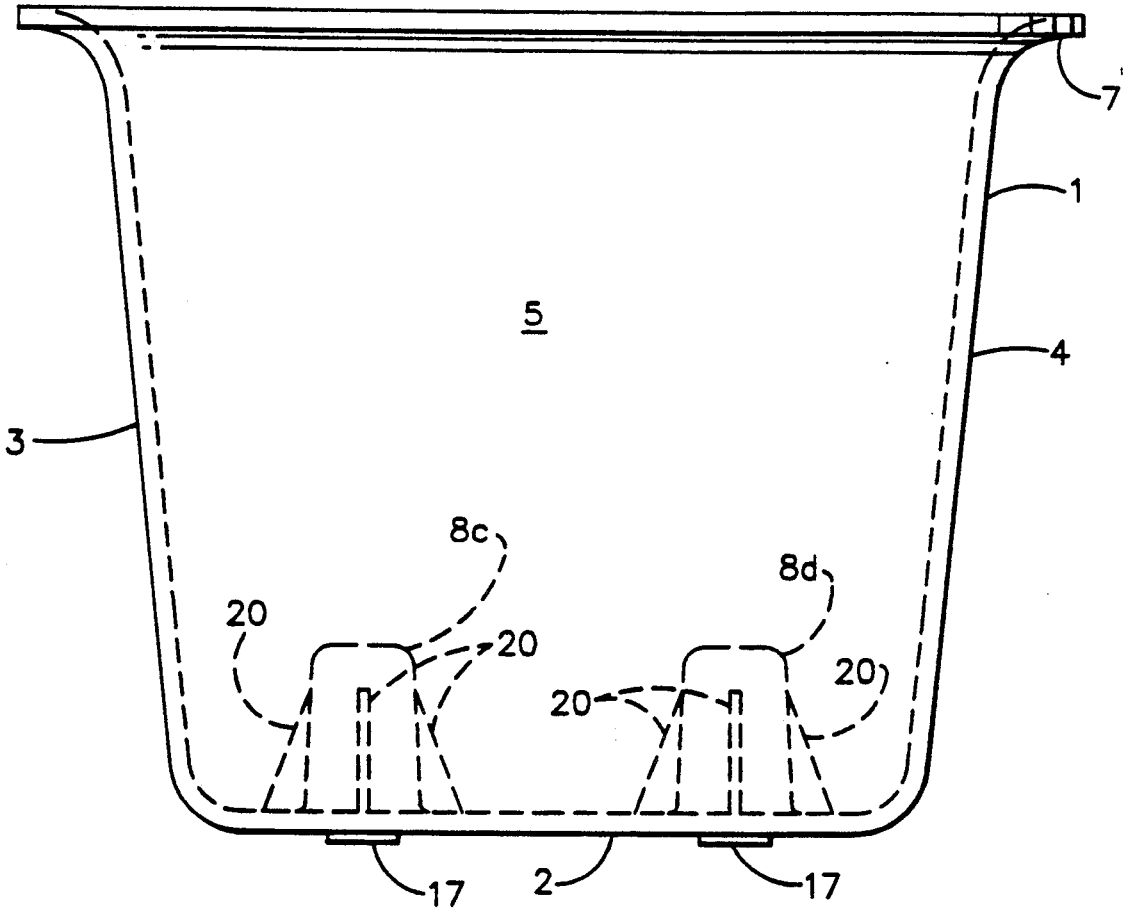
FIG. 2 is an end elevation of the planter as seen from the right of FIG. 1.
Figure 3:
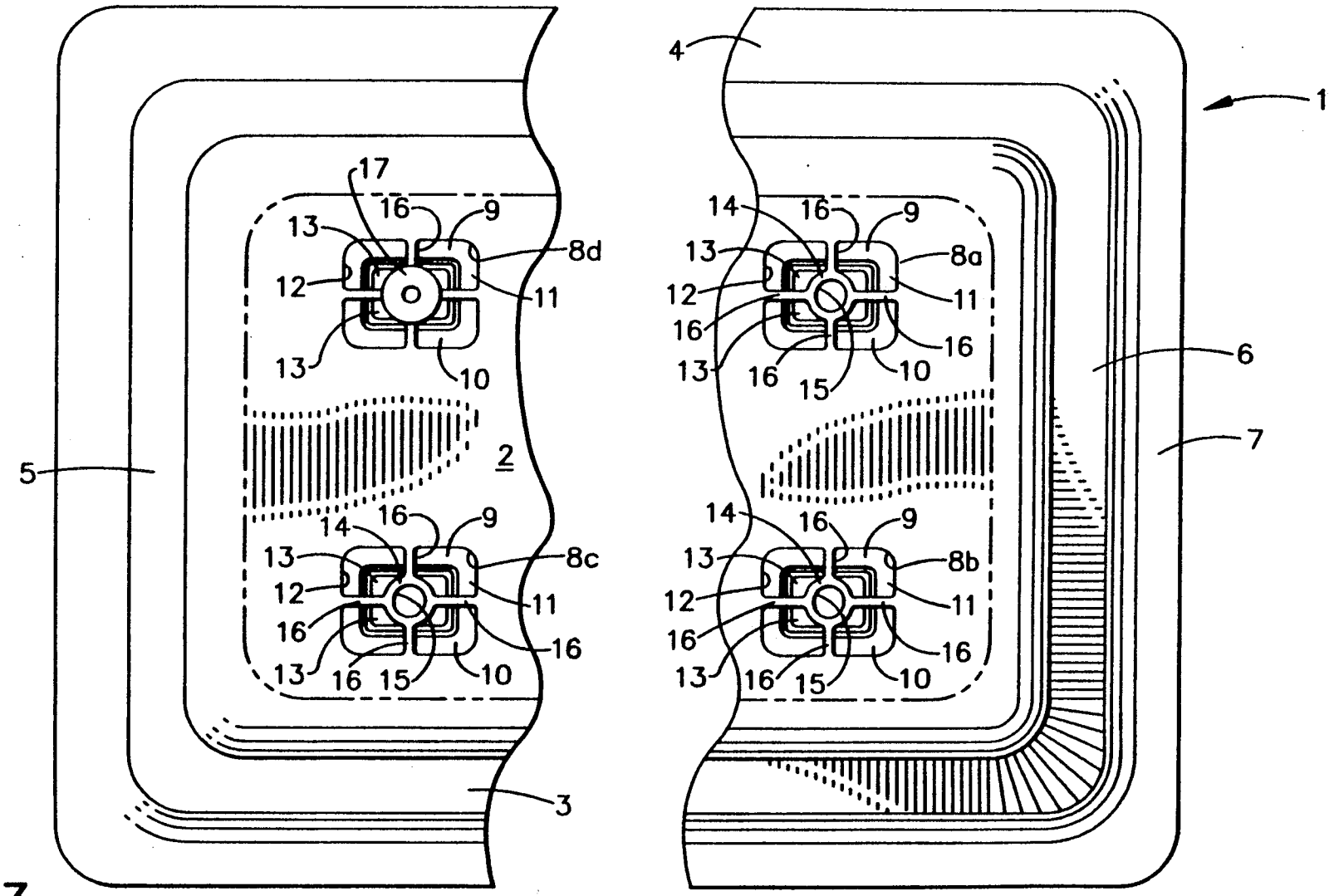
FIG. 3 is a fragmentary bottom view of the planter of FIG. 1.
Figure 4:
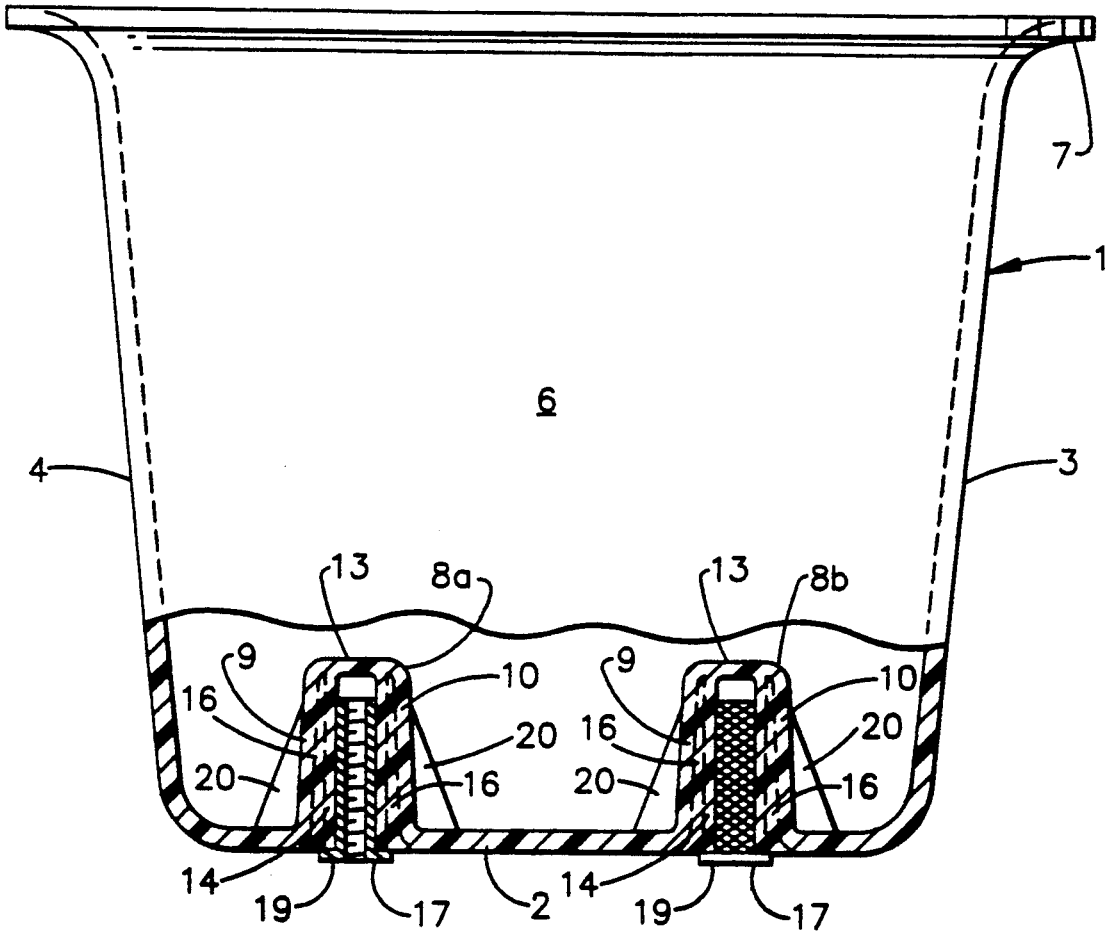
FIG. 4 is an end elevational view of the planter, partly in cross-section, as seen from the right of FIG. 1.

The planter of the present invention may be made of any appropriate material such as metal, plastic, synthetic resin or wood. The planter is generally an elongated structure having a bottom, side and end walls and an open top. The precise configuration of the planter does not constitute a limitation of the present invention. The bottom of the planter should be of such thickness, or of such configuration, as to accommodate one or more internally threaded, vertically oriented bushings, as will be apparent hereinafter.

Reference is first made to FIGS. 1–4 wherein like parts have been given like index numerals. For purposes of an exemplary showing, the invention will be described in its application to a preferred embodiment of planter constituting a unitary, one-piece, structure molded of appropriate plastic or synthetic resin material. While the embodiment of FIGS. 1–4 is a preferred embodiment, it is not intended to be limiting.

The planter, generally indicated at 1, comprises an elongated, substantially rectangular structure having a bottom 2, side walls 3 and 4, and end walls 5 and 6. The bottom 2 is substantially planar and the sidewalls 3 and 4 and the end walls 5 and 6 extend upwardly and slightly outwardly therefrom. The upper edges of side walls 3 and 4 and end walls 5 and 6 terminate in an outwardly extending peripheral flange 7 which defines the open top of the structure.

In the particular embodiment illustrated, the bottom 2 has four identical upstanding sockets 8*a*, 8*b*, 8*c* and 8*d* formed therein. Since the sockets 8*a*–8*d* are identical, like portions thereof have been given like index numerals.

The sockets 8*a*–8*d* extend vertically upwardly into the interior of planter 1. The sockets 8*a*–8*d* are generally rectangular in horizontal cross-section, each having side walls 9 and 10 and end walls 11 and 12. The side walls 9 and 10 and the end walls 11 and 12 extend upwardly and slightly inwardly, terminating in an integral, substantially horizontal top wall 13.

Centrally of each socket 8*a*–8*d* there is an integral cylindrical element 14 which extends from the top wall 13 vertically downwardly to a level equivalent to the exterior surface of bottom 2. Each of the cylindrical members 14 has an axial bore 15, the purpose of which will be apparent hereinafter. Each of the sockets 8*a*–8*d* are completed by the provision of integral reinforcing webs 16 extending radially from the cylindrical member 14 to the adjacent socket side walls 9 and 10 and end walls 11 and 12.

The bore 15 of each of the cylindrical members 14 is intended to receive a cylindrical bushing 17. The bushings 17 may be made of any appropriate materials such as brass or the like. Each of the bushings 17 has an axial threaded bore 18. One end of each bushing 17 is provided with an annular, laterally extending flange 19 which determines the depth to which the bushing extends into its respective cylindrical member 14.

Each bushing 17 may be fixed within its respective cylindrical member 14 in any appropriate manner. This can be accomplished simply by providing a forced fit. Alternatively, each bushing 17 may be held within its respective cylindrical member 14 by adhesive means. It is within the scope of the invention to externally thread each of the bushings 17 and internally thread each of the cylindrical members 14 so that the engagement therebetween is a threaded one. A preferred method of fixing the bushings 17 in their respective cylindrical members 14 contemplates the provision of knurling on the exterior surface of each of the bushings 17. The bushings 17 are so sized as to have a close fit within their respective cylindrical members 14. Once inserted in their respective cylindrical members 14, each bushing 17 is locked in place by sonic welding.

The planter 1 of FIGS. 1–4 can be securely and safely mounted on a wide variety of deck rails, balcony rails, iron railings, divider walls and the like, through the use of appropriate hardware, as will next be described.

Figure 5:
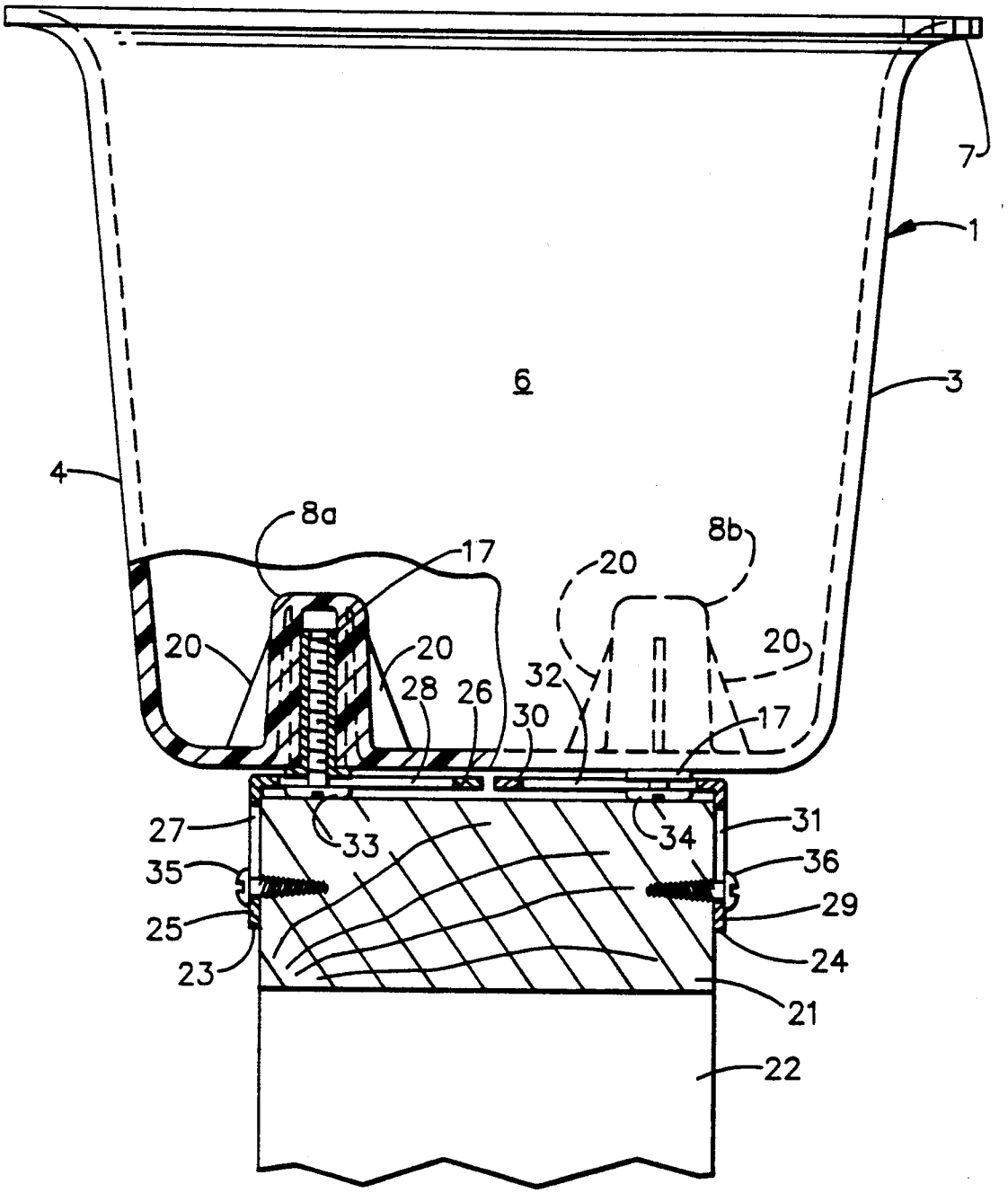
FIG. 5 is a fragmentary end elevational view, partly in cross-section, of a first embodiment of the present invention.
Figure 6:
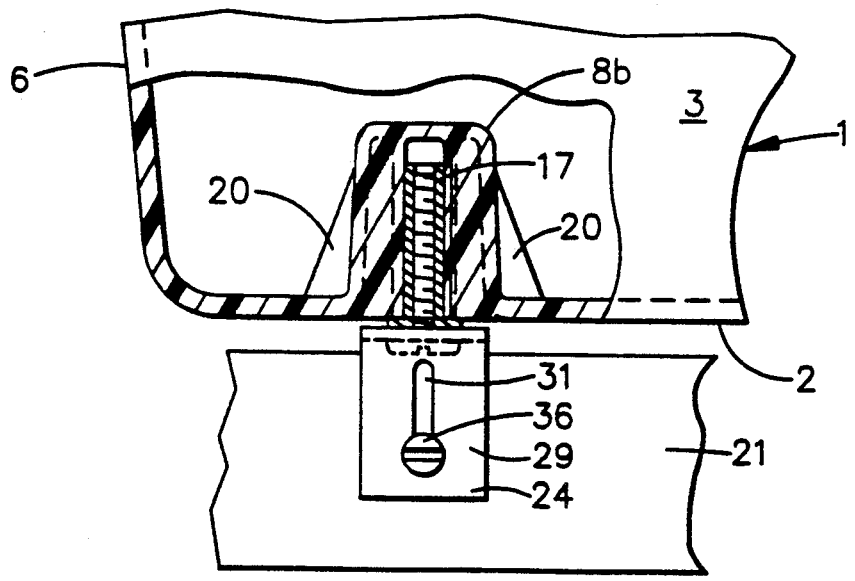
FIG. 6 is a fragmentary side elevational view, partly in cross-section, of the embodiment of FIG. 5.

Reference is made to FIGS. 5 and 6, wherein the planter 1 is shown mounted on the typical wooden railing of a porch, a house deck, the deck of an above ground pool, or the like. The wooden railing comprises a horizontal top rail (such as a 2"×4" rail) 21 supported by a plurality of vertically oriented wooden members or balusters (such as 2"×4"'s), one of which is fragmentarily shown at 22.

For this purpose, a pair of identical angle brackets 23 and 24 are provided. The angle bracket 23 has a short leg 25 and a long leg 26. The short leg 25 has a central, longitudinally extending slot 27 formed therein. Similarly, the long leg 26 has a central, longitudinally extending slot 28 formed therein. The legs 25 and 26 of angle bracket 23 are at right angles with respect to each other.

Angle bracket 24, being identical to angle bracket 23, comprises a short leg 29 and a long leg 30. The short leg 29 has a central, longitudinally extending slot 31 formed therein and the long leg 30 has a central, longitudinally extending slot 32 formed therein. Again, the legs 29 and 30 are perpendicular with respect to each other. Angle brackets 23 and 24 may be made of any suitable material such as metal, plastic or the like.

Angle bracket 23 is affixed to the planter 1 by means of a headed bolt 33 passing through the long leg slot 28 and threadedly engaged in the bushing 17 of socket 8*a*. Similarly, angle bracket 24 is affixed to the planter 1 by a headed bolt 34 passing through the long leg slot 32 and threadedly engaged in the bushing 17 of socket 8*b*. It will be noted that the free ends of the long legs 26 and 30 of angle brackets 23 and 24 are opposed and spaced from each other by a short distance. The short legs 25 and 29 of angle brackets 23 and 24 extend vertically downwardly in parallel spaced relationship. The long leg slots 28 and 32 of angle brackets 23 and 24 are so adjusted with respect to bolts 33 and 34 that the space between the angle bracket short legs 25 and 29 is such as to just nicely receive the to rail 21 therebetween. Wood screws 35 and 36 pass through the short leg slots 27 and 31 and into the sides of the top rail 21, firmly securing the angle brackets 23 and 24 to the top rail 21. It will be understood by one skilled in the art that similar pairs of angle brackets, bolts and wood screws will be provided for the sockets 8*c* and 8*d* of planter 1. The second set of angle brackets (not shown) will be affixed to the planter 1 and to the top rail 21 in precisely the same manner described with respect to angle brackets 23 and 24. Once this has been accomplished, it will be appreciated by one skilled in the art that the planter 1 will be safely and securely affixed to the top rail 21. While not intended to be limited by dimensions, for purposes of a complete disclosure, the embodiment of FIG. 5 was assembled utilizing angle brackets, the long legs of which were 1 13/16" long and the short legs of which were 1¼" long.

Figure 8:
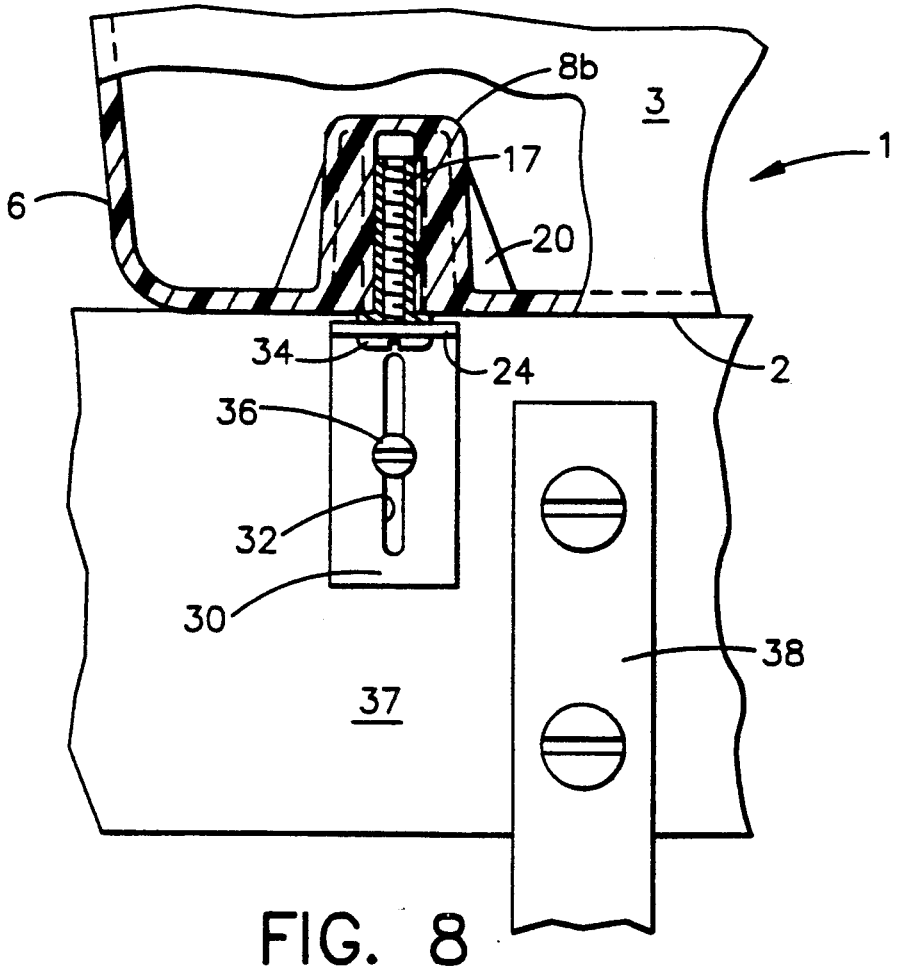
FIG. 8 is a fragmentary side elevational view of the embodiment of FIG. 7, partly in cross-section.
Figure 7:
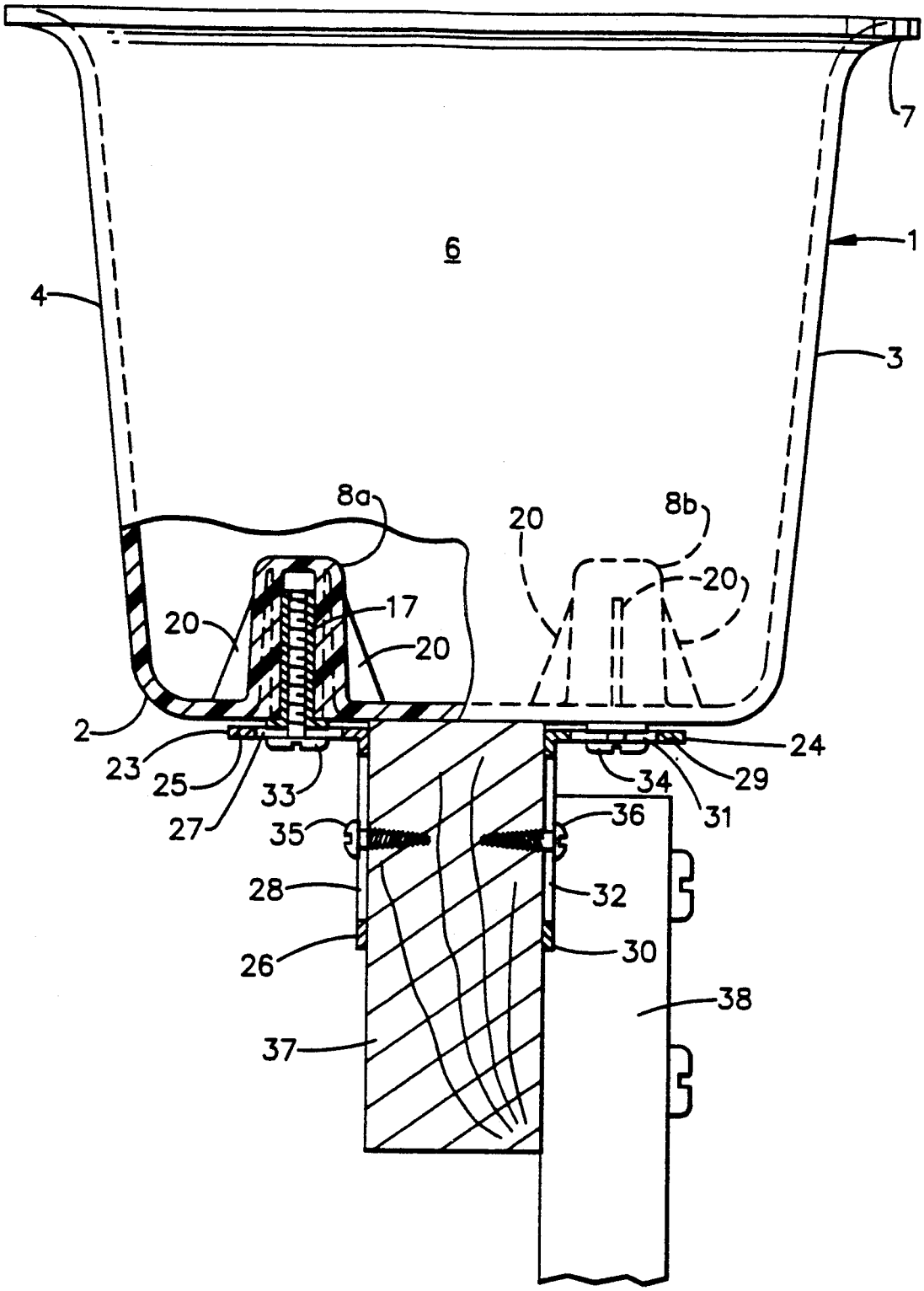
FIG. 7 is a fragmentary end elevational view of another embodiment of the present invention, partly in cross-section.

Reference is now made to FIGS. 7 and 8. These figures illustrate the planter 1 mounted on the horizontal top rail 37 of a deck or balcony railing. The top rail 37 may be a 2"×4" or a 2"×6". For purposes of an exemplary showing, the top rail 37 is illustrated as comprising a 2"×4". In this instance, however, the long cross-sectional dimension of the top rail 37 is oriented vertically. The top rail 37 is supported by a plurality of vertically oriented balusters affixed to one side thereof. One such baluster is fragmentarily illustrated at 38.

In the embodiment of FIGS. 7 and 8, the very same hardware is used as in the embodiment of FIGS. 5 and 6, and like parts have been given like index numerals In this instance, however, the angle bracket 23 is affixed to planter 1 by means of the headed bolt 33 passing through the slot 27 of short leg 25 and threadedly engaged in the bushing 17 of socket 8*a*. Similarly, angle bracket 24 is affixed to the planter 1 by means of headed bolt 34 passing through slot 31 of short leg 29 and threadedly engaged in the bushing 17 of socket 8*b*. As a consequence, the long angle bracket legs 26 and 30 depend vertically downwardly and are in parallel spaced relationship with respect to each other. The short leg slots 27 and 31 are so adjusted with respect to bolts 33 and 34 that the distance between the angle bracket long legs 26 and 30 is such that the top rail 37 will be just nicely received therebetween. The long angle bracket legs 26 and 30 are affixed to top rail 37 by wood screws 35 and 36 passing through the long leg slots 28 and 32, respectively.

Again it will be understood that an identical set of angle brackets, bolts and wood screws will be provided for the sockets 8*c* and 8*d* of planter 1 and will be assembled in the same manner described with respect to angle brackets 23 and 24. Once this is accomplished, the planter 1 will be firmly and safely mounted on the horizontal upper surface of top rail 37.

Figure 9:
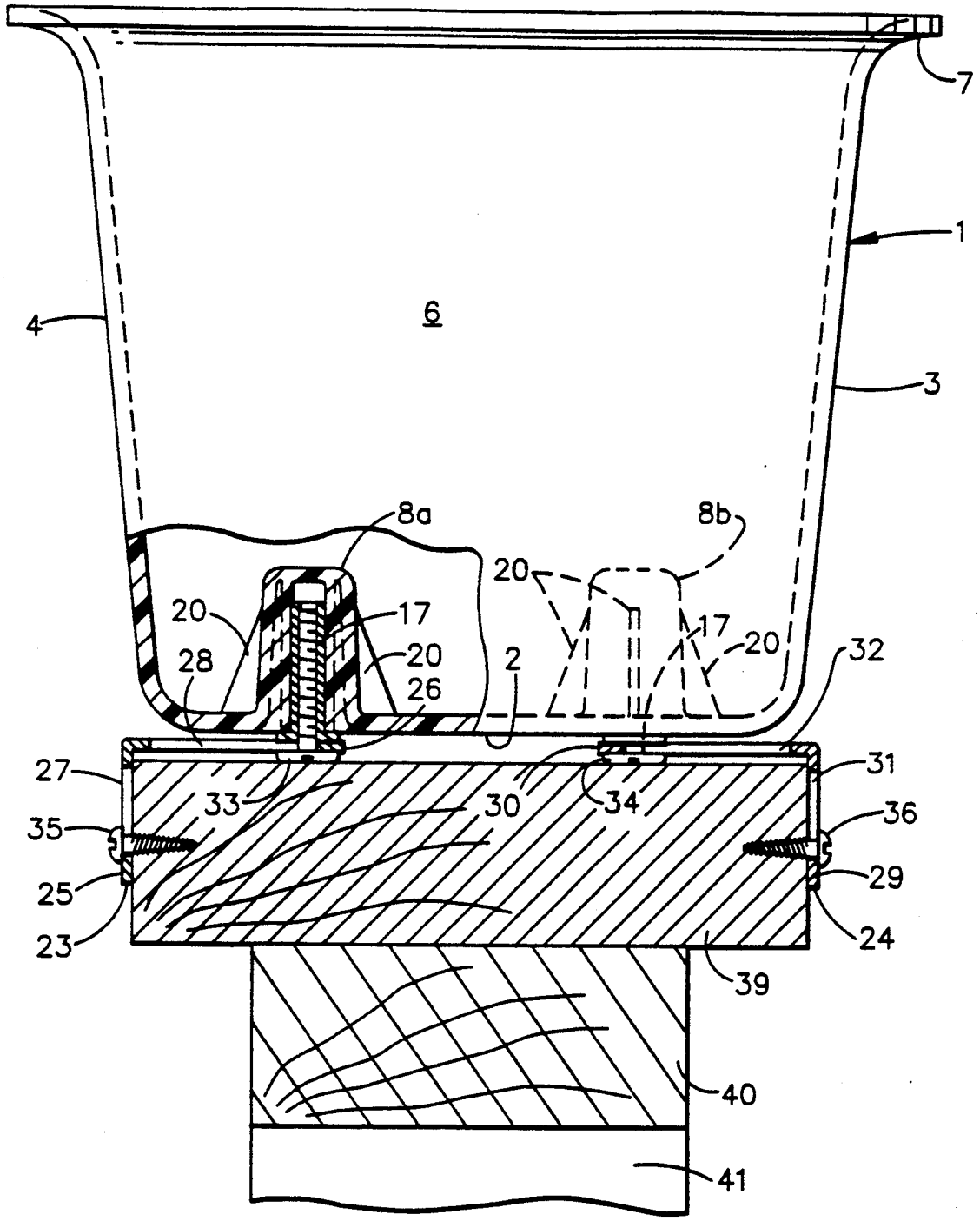
FIG. 9 is an end elevational view, partly in cross-section, of another embodiment of the present invention.

Yet another embodiment is illustrated in FIG. 9 In this instance, the planter 1 is illustrated as being mounted on the upper horizontal surface of a horizontally oriented top rail 39 constituting a 2"×6". The horizontal top rail 39 is, in turn, affixed to the upper surface of a second horizontal rail 40 comprising a 2"×4". The horizontal railing 40 is supported by a plurality of vertically oriented balusters (such as 2"×4"s), one of which is fragmentarily illustrated at 41.

Again, the same hardware is used in this embodiment as was used in the embodiment of FIGS. 5 and 6 and the embodiment of FIGS. 7 and 8, and like parts have been given like index numerals. In this instance, the long leg 26 of angle bracket 23 is affixed to the planter 1 by means of the headed bolt 33 passing through the long leg slot 28 and threadedly engaged in the bushing 17 of socket 8*a*. Similarly, the angle bracket 24 is affixed to the planter 1 by means of the headed bolt 34 passing through the slot 22 of long leg 30 and threadedly engaged in the bushing 17 of planter socket 8*b*. As a result of this, and as in the case of the embodiment of FIGS. 5 and 6, the angle bracket short legs 25 and 29 depend vertically downwardly and are in parallel spaced relationship with respect to each other. The slots 28 and 32 in long legs 26 and 30 are so adjusted with respect to headed bolts 33 and 34, respectively, that the distance between the short legs 25 and 29 of angle brackets 23 and 24 is such as to just nicely receive the side edges of the top rail 39. The angle bracket short legs 25 and 29 are affixed to the side surfaces of top rail 39 by means of the wood screws 35 and 36 passing through the short leg slots 27 and 31, respectively. A similar arrangement of angle brackets, headed bolts and wood screws will be provided for the planter sockets 8*c* and 8*d*. When this is accomplished, the planter 1 will be firmly and safely affixed to the upper surface of top rail 39.

It will be evident from the description thus far that the same hardware can be used to mount planter 1 on various types of railings. While an individual bracket for each embodiment thus far described could be used, this would require a large inventory of different brackets.

Figure 10:
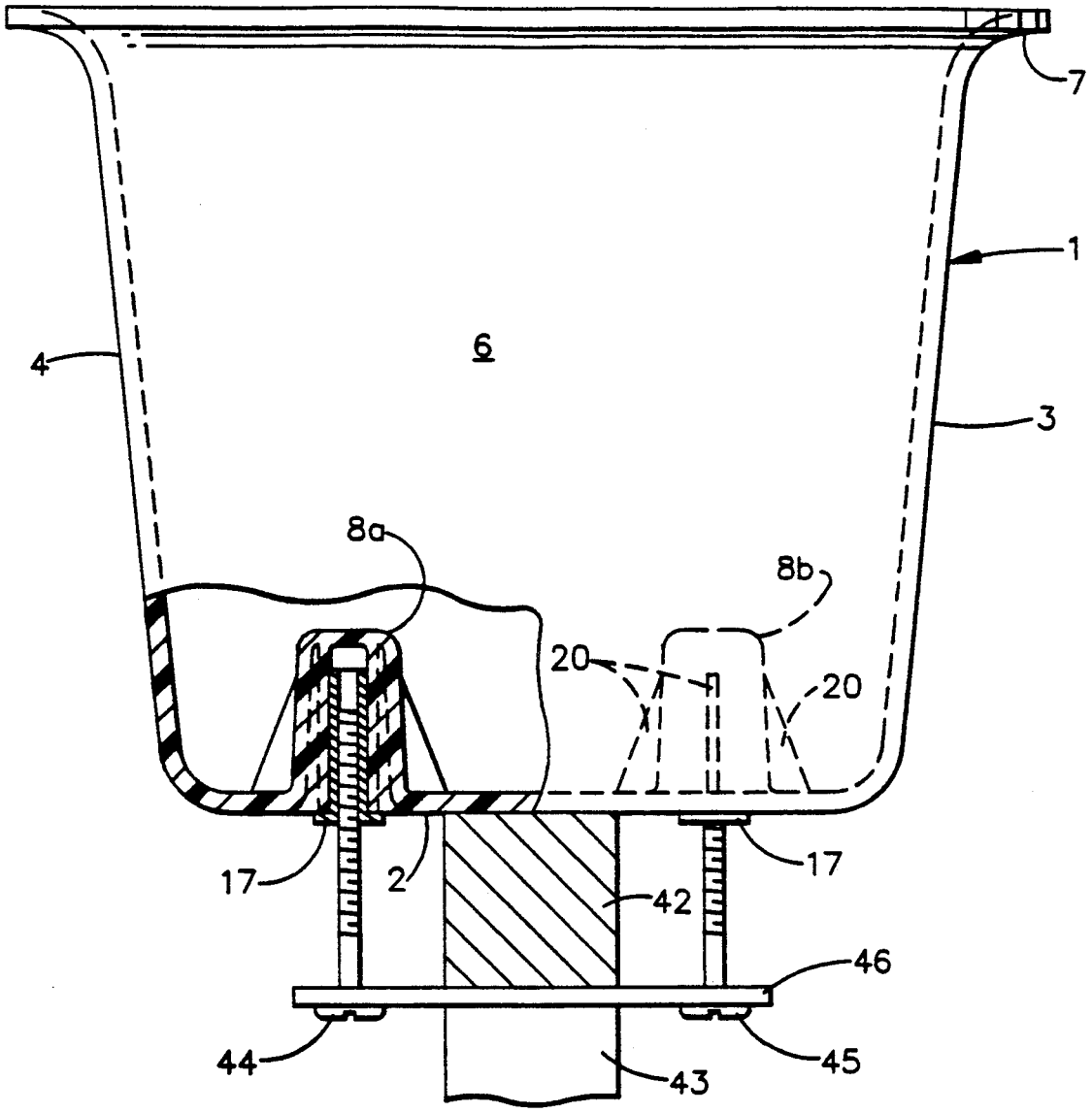
FIG. 10 is an end elevational view, partly in cross-section, of another embodiment of the present invention.
Figure 11:
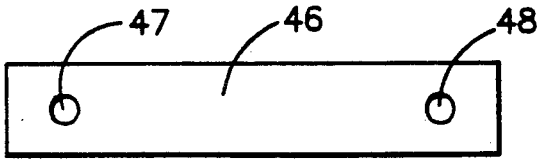
FIG. 11 is a plan view of the plate-like bracket of FIG. 10.

Reference is now made to FIGS. 10 and 11. FIG. 10 illustrates the planter 1 mounted on the upper horizontal surface of a metal handrail 42. The metal handrail 42 is of rectangular cross-section, and in this instance, for purposes of an exemplary showing, is illustrated as having a square cross-section. The metal handrail 42 is supported by a plurality of upright, vertical metal balusters, one of which is fragmentarily shown at 43.

The mounting illustrated in FIG. 10 is accomplished through the agency of a pair of bolts 44 and 45 and an elongated bar bracket 46. The headed bolts 44 and 45 differ from the headed bolts 33 and 34 of the previous embodiment only in that they are somewhat longer. As is most clearly shown in FIG. 11, the bar bracket 46 comprises an elongated metallic plate having perforations 47 and 48 centered thereon near its ends.

The bottom 2 of the planter 2 rests upon the upper horizontal surface of handrail 42. The bar bracket 46 is located against the lower horizontal surface of the handrail 42. The bar bracket 46 is attached to the planter 1 by bolts 44 and 45 passing through bar bracket perforations 47 and 48, respectively, and threadedly engaged in the bushings 17 of sockets 8*a* and 8*b*. The structure will be provided with a second identical bar bracket (not shown) and a second pair of identical headed bolts (not shown) for engagement in the bushings 17 of sockets 8*c* and 8*d*. When the bolts 44 and 45 are appropriately tightened, the handrail 42 will be firmly engaged by the bottom surface 2 of the planter and the bar bracket 46. The same is true of the similar hardware assembly at the other end of planter 1. As a result, the planter will be firmly and safely mounted on the metal handrail 42.

Figure 12:
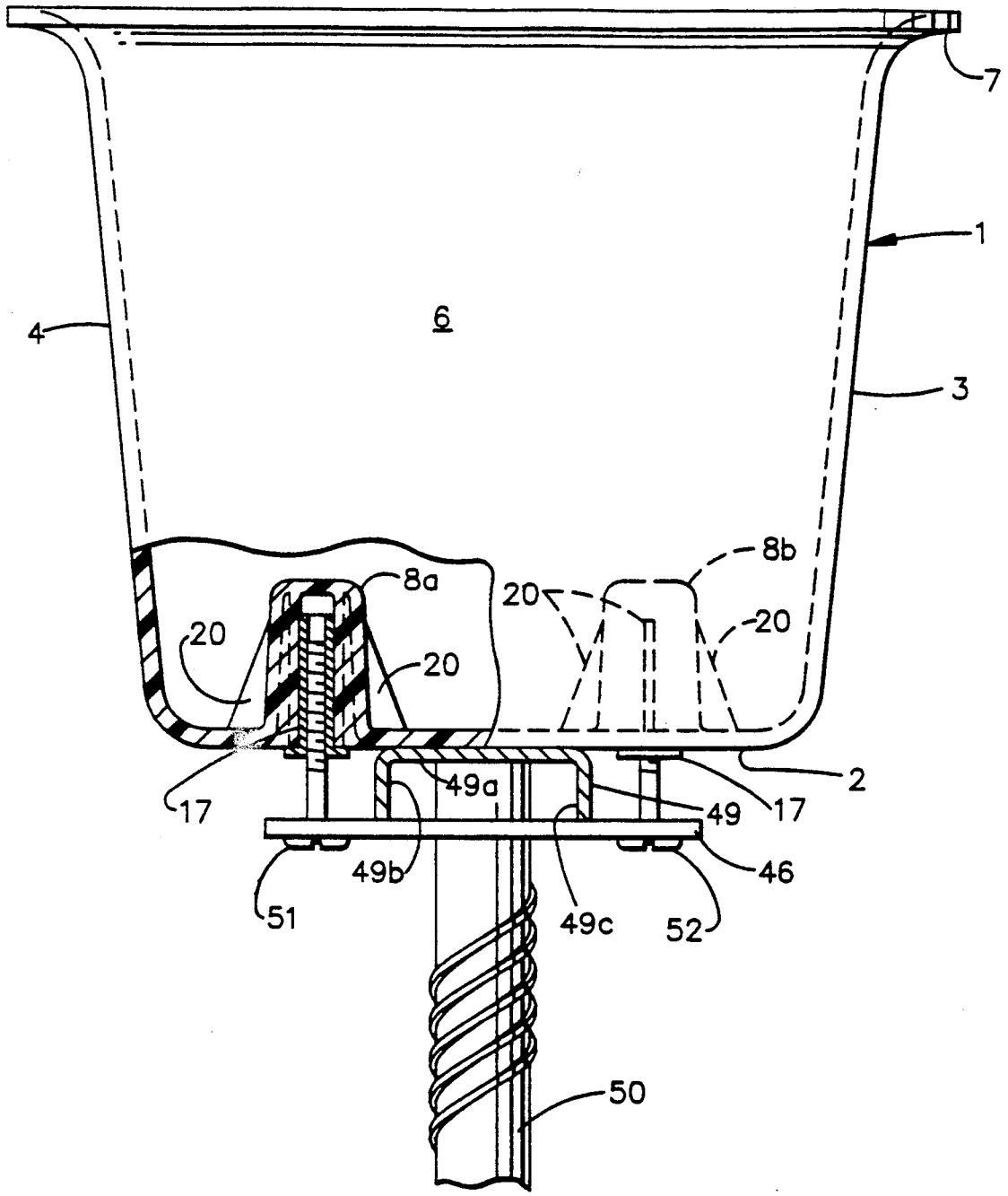
FIG. 12 is a fragmentary end elevational view, partly in cross-section, of yet another embodiment of the present invention.

FIG. 12 illustrates the planter 1 mounted on the handrail of a metal railing wherein the handrail 49 is of channel-shaped cross-section. To this end, the handrail 49 has a horizontal portion 49*a* terminating at its edges in downwardly depending legs 49*b* and 49*c*. The handrail 49 is supported on a plurality of metallic balusters, one of which is fragmentarily shown at 50 in FIG. 12.

In this instance, the attachment hardware comprises the same bar bracket 46 illustrated in FIG. 11, together with a pair of headed bolts 51 and 52. The headed bolts 51 and 52 are substantially the same as headed bolts 44 and 45, and are of appropriate length, depending upon the size of handrail 49. The planter 1 is located with its bottom 2 resting upon the horizontal portion 49*a* of handrail 49. The bar bracket 46 is located beneath the handrail 49 and is attached to the planter 1 by the bolts 51 and 52 passing through the perforations 47 and 48 of bar bracket 46 and threadedly engaged in the bushings 17 of sockets 8*a* and 8*b*. It will be understood that the planter sockets 8*c* and 8*d* will be provided with a second bar bracket (not shown) and a second pair of bolts (not shown), identical to those illustrated in FIG. 12. When the bolts are appropriately tightened in their respective bushings, the upper surface of handrail 49 will be engaged by the bottom 2 of the planter 1, and the bottom edges of the handrail legs 49*b* and 49*c* will be engaged by the bar brackets, to firmly and safely mount the planter 1 on handrail 49.

Figure 13:
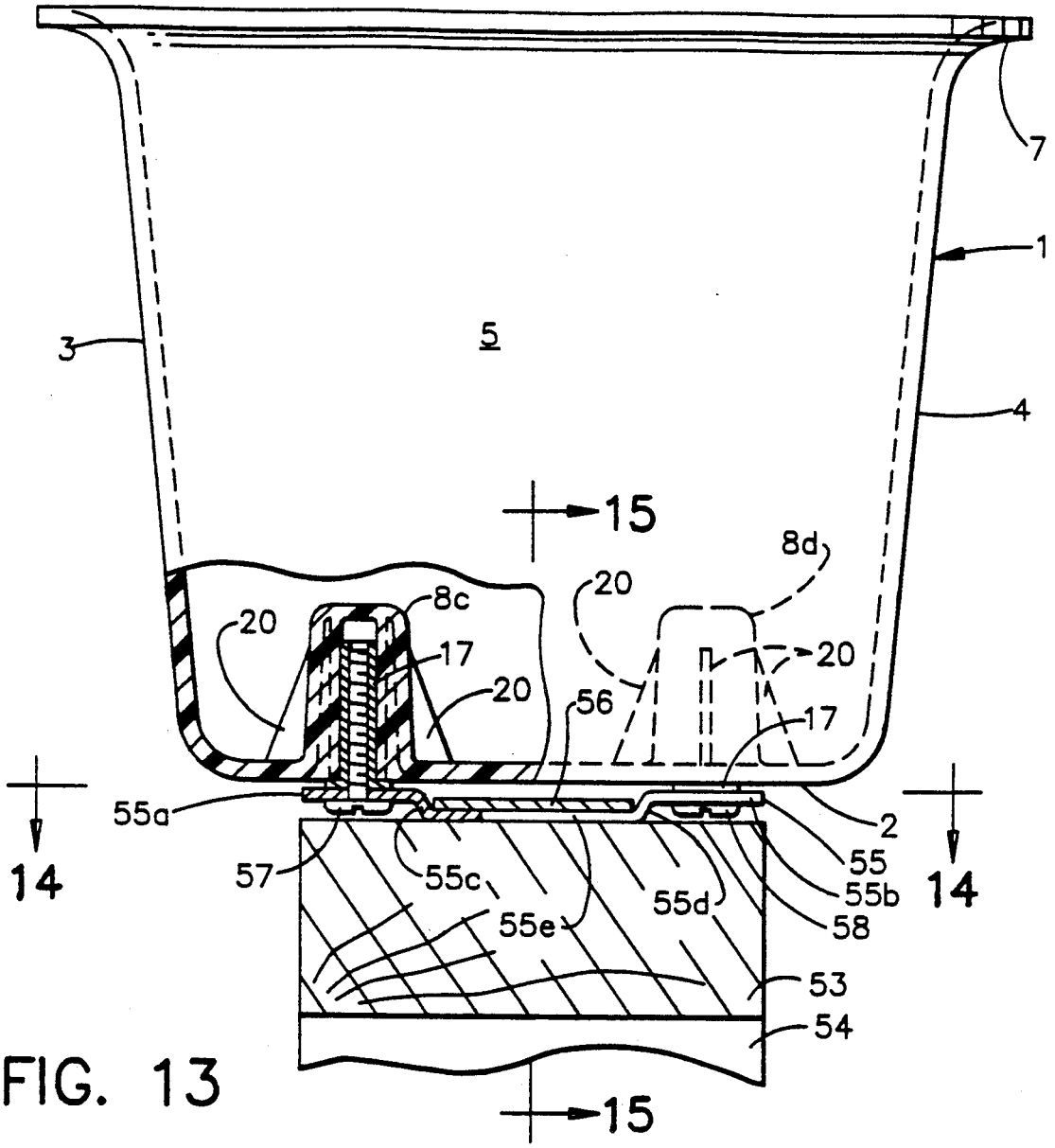
FIG. 13 is a fragmentary end elevational view of another embodiment of the present invention, partly in cross-section.
Figure 14:
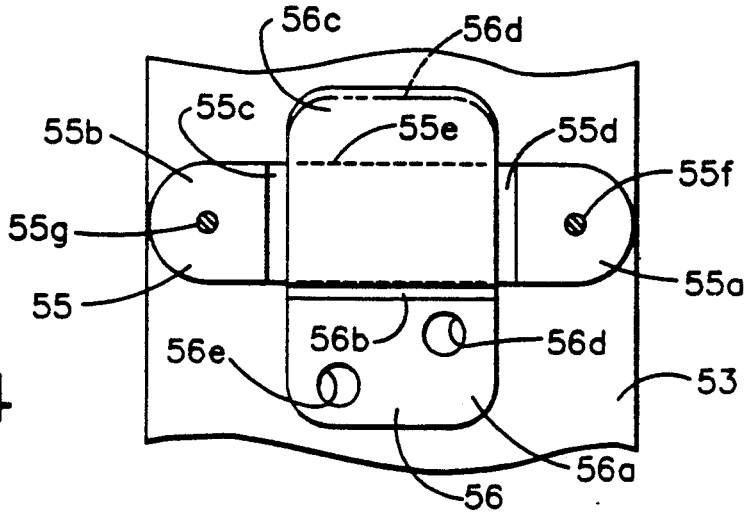
FIG. 14 is a fragmentary cross-sectional view taken along section line 14—14 of FIG. 13.
Figure 15:
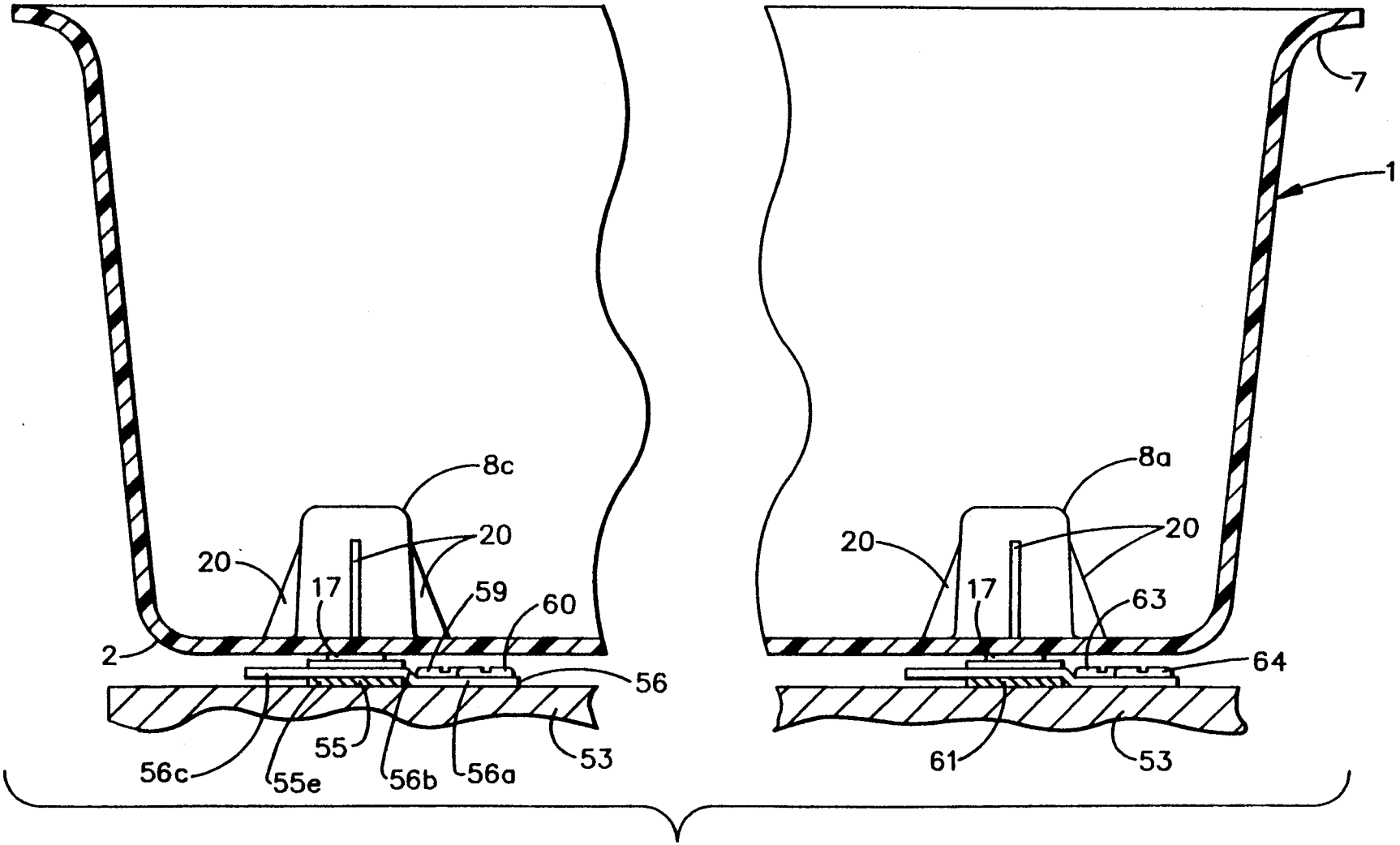
FIG. 15 is a fragmentary cross-sectional elevational view of the embodiment of FIG. 13.

FIGS. 13–15 illustrate a preferred embodiment of the present invention applicable to any horizontal surface on which it is desired to mount the planter 1. As a non-limiting example, and for purposes of an exemplary showing, the embodiment will be described as applied to a deck railing of the type shown and described with respect to FIG. 5. The deck railing comprises a 2"×4" horizontal top rail supported by a plurality of vertical balusters, which, themselves, may be 2"×4"s. In FIGS. 13 and 14, the top rail is shown at 53. One of the supporting balusters is fragmentarily illustrated at 54.

FIG. 13 is an end elevational view, partly in cross-section, of the planter 1 as seen from the left of FIG. 14.

Attachment of the planter 1 on the upper horizontal surface of railing 53 is accomplished by two identical sets of cooperating brackets, one set for each pair of sockets 8*a*–8*b* and 8*c*–8*d*. The set of brackets for the pair of sockets 8*c*–8*d* is illustrated in FIGS. 13, 14 and 15. The bracket set comprises a first bracket 55 and a second bracket 56.

As is best shown in FIGS. 13 and 15, the bracket 55 comprises an elongated member of metal, plastic or the like. The bracket 55 has co-planar, horizontal end portions 55*a* and 55*b*. The end portions 55*a* and 55*b* lead to downwardly and inwardly sloping portions 55*c* and 55*d*. The portions 55*c* and 55*d*, in turn, lead to a central horizontal planar portion 55*e*. The portion 55*e* is parallel to the end portions 55*a* and 55*b* and is adapted to rest on the upper horizontal surface of top rail 53. The downwardly and inwardly sloping portions 55*c* and 55*d* are of such size that the end portions 55*a* and 55*b* of bracket 55 are raised from the upper horizontal surface of railing 53 by a distance sufficient to accommodate the heads of headed bolts 56 and 57.

As is most clearly shown in FIG. 15, the end portions 55*a* and 55*b* have perforations 55*f* and 55*g*, respectively, allowing the headed bolts 56 and 57 to extend therethrough. The bolts 56 and 57 are threadedly engaged in the bushings 17 of sockets 8*c* and 8*d*. In this manner, the bracket 55 is affixed to the bottom 2 of the planter 1.

The second bracket, 56, is most clearly shown in FIGS. 14 and 15. Again, the bracket 56 is made of metal, plastic or the like and comprises an elongated member. The bracket 56 has a first planar mounting portion 56*a*. The portion 56*a* is followed by an upwardly and forwardly extending portion 56*b*. The portion 56*b* terminates in a planar tongue portion 56*c*. The tongue portion 56*c* is parallel to the mounting portion 56*a*. The upwardly and forwardly sloping portion 56*b* of bracket 56 is of such size that the tongue portion 56*c* is located above the upper surface of top rail 53 by a distance substantially equivalent to the thickness of the central planar portion 55*e* of bracket 55.

The mounting portion 56*a* of bracket 56 is provided with a pair of perforations 56*d* and 56*e*. The perforations 56*d* and 56*e* enable the bracket 56 to be affixed to the top rail 53 by means of wood screws 59 and 60 (see FIG. 14).

As indicated above, the pair of sockets 8*a* and 8*b* is provided with an identical set of brackets. As is shown in FIG. 14, there is a first bracket 61 identical to bracket 55 and a second bracket 62, identical to bracket 56. The bracket 61 is affixed to the bottom 2 of planter 1 by headed bolts (not shown) threadedly engaged in the bushings of sockets 8*a* and 8*b*. The bracket 62 is affixed to the upper surface of top rail 53 by wood screws 63 and 64, equivalent to wood screws 59 and 60.

When it is desired to mount the planter 1 on railing 53, the planter is placed on the upper surface of railing 53 in such a position that the brackets 55 and 61 are located to the left of brackets 56 and 62, as viewed in FIG. 14. The planter 1 is then shifted to the right (as viewed in FIG. 14) until the central portions of brackets 55 and 61 slip under the tongue portions of brackets 56 and 62, as illustrated in FIG. 14. Once the planter 1 is positioned as illustrated in FIG. 14, it is safely and securely affixed to the upper horizontal surface of railing 53. To remove the planter 1 from railing 53, it is only necessary to shift the planter to the left as viewed in FIG. 14, until the central portions of brackets 55 and 61 slip out from under the tongue portions of brackets 56 and 62. At this point, the planter 1 can be lifted and removed from railing 53. An advantage of this embodiment of the present invention lies in the fact that the mounting brackets 55, 56, 61, and 62 are substantially hidden by the planter 1, itself.

It would be within the scope of the invention to elongate perforations 55*f* and 55*g* in bracket 55 (the same being true of bracket 61). This would enable adjustment of planter 1 transversely of top rail 53 should, for example, one or both of the brackets 56 and 62 have been located slightly off-center on the upper surface of top rail 53. It is also within the scope of the invention to provide the tongue portion 56*c* of bracket 56 with a leading edge sloping downwardly and forwardly. The bend line is indicated in FIG. 15 by broken line 56*d*. This enables the tongue portion 56*c* to slip more easily between the bottom 2 of planter 1 and the portion 55*e* of bracket 55. The tongue portion of bracket 62 could be provided with a similarly configured leading edge.

Figure 16:
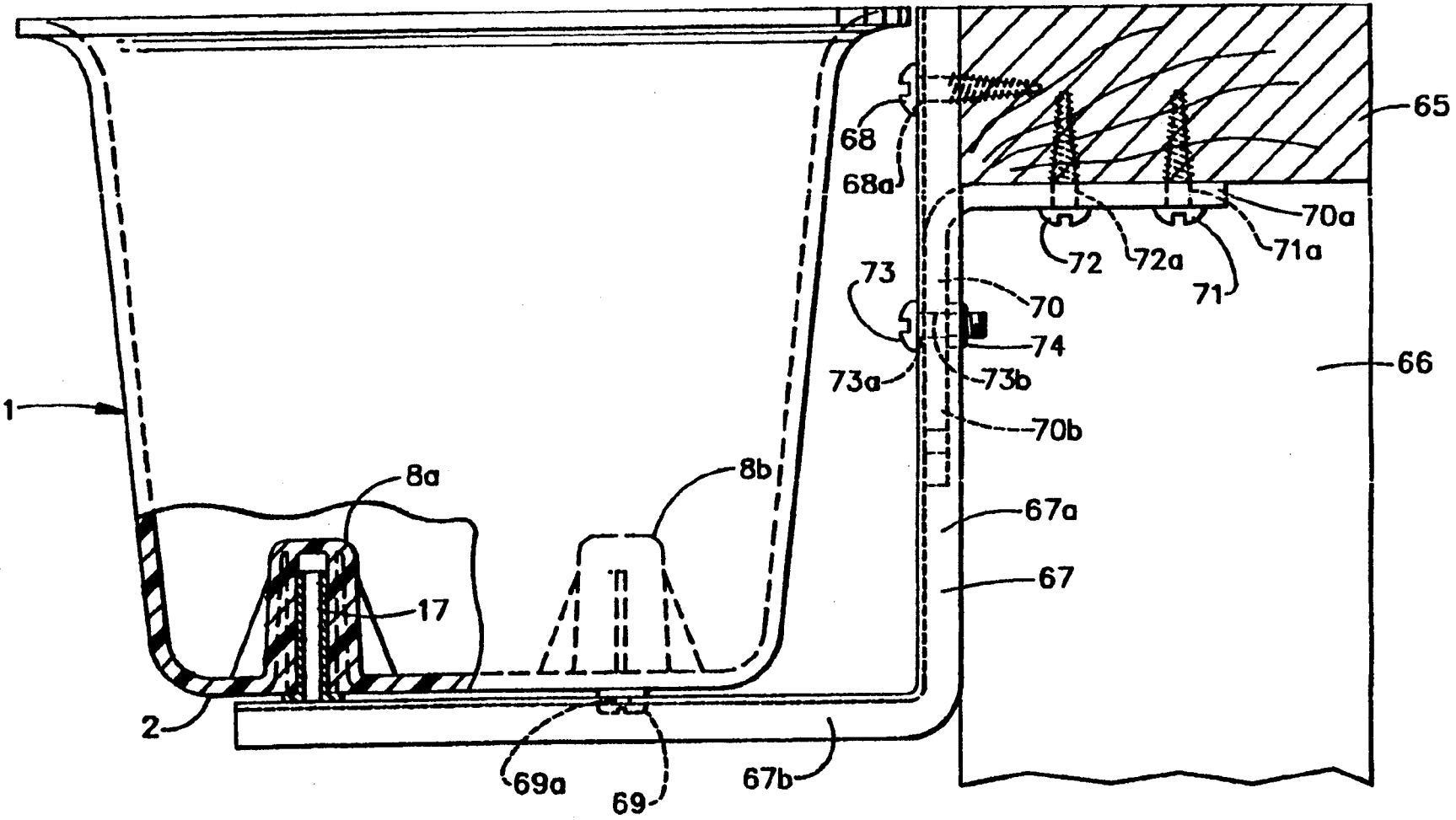
FIG. 16 is a fragmentary end elevational view, partly in cross-section, of an embodiment wherein the planter is mounted alongside the top rail of the railing.
Figure 17:
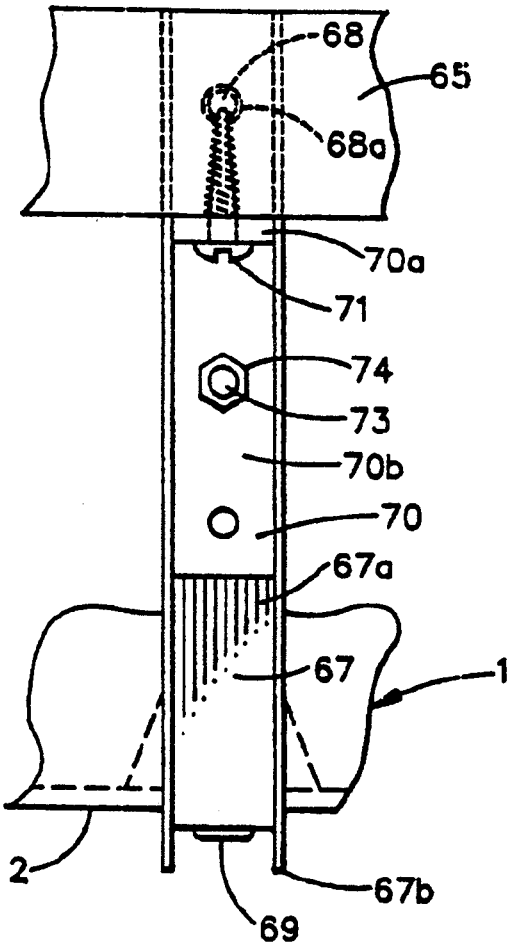
FIG. 17 is a fragmentary side elevational view of the structure of FIG. 16 as seen from the right of FIG. 16.

FIGS. 16 and 17 illustrate means for supporting the planter 1 to one side of a deck or porch railing of the type described with respect to FIG. 5. Once again, the railing comprises a 2"×4" top rail 65 mounted on a plurality of 2"×4" balusters, one of which is fragmentarily shown at 66. In this embodiment, as in the previous embodiments, identical hardware is provided for each pair of planter sockets 8*a*–8*b* and 8*c*–8*d*. The hardware for each socket pair comprises two angle brackets. Turning particularly to FIG. 16, a first angle bracket 67 is provided having a vertical leg 67*a* and a horizontal leg 67*b*. The leg 67*a* is of a length substantially equivalent to the height of planter 1. The leg 67*b* may be of the same length. As is clearly shown in the Figures, the bracket legs 67*a* and 67*b* are of generally U-shaped cross-section.

Leg 67*a*, near its upper end, is provided with a perforation 68*a* for the receipt of a wood screw 68, by which the bracket 67 is attached to the side of top rail 65. Horizontal leg 67*b* is provided with a perforation 69*a* enabling a headed bolt 69 to pass therethrough and be threadedly engaged in the bushing 17 of socket 8*b*. If desired, the leg 69*b* may be provided with a second perforation (not shown) enabling a second headed bolt (not shown) to pass therethrough and be threadedly engaged in the bushing 17 of socket 8*a*.

The second bracket of the assembly comprises an angle bracket 70 having a horizontal leg 70*a* and a vertical leg 70*b*. The legs 70*a* and 70*b* may be of the same length and are of rectangular cross-section. The horizontal leg 70*a* is provided with a pair of perforations 71*a* and 72*a* to accommodate a pair of wood screws 71 and 72 by which the leg 70*a* is affixed to the underside of top rail 65. The leg 70*a* is so located on the underside of top rail 65 that the leg 70*b* is aligned with the leg 67*a* of bracket 67 and is located within its U-shaped cross-section. The leg 67*a* of bracket 67 and the leg 70*b* of bracket 70 have coaxial perforations 73*a* and 73*b* to accommodate a bolt 73 provided with a nut 74. Thus, the bracket 70 cooperates with the bracket 67 to maintain bracket leg 67*a* vertical despite the weight of planter 1. It will be understood that a second set of brackets (not shown), identical to brackets 67 and 70 will be provided for the pair of sockets 8*c* and 8*d* near the other end of the planter 1. The second set of brackets will be mounted in precisely the same way both with respect to top rail 65 and the planter 1.

Figure 18:
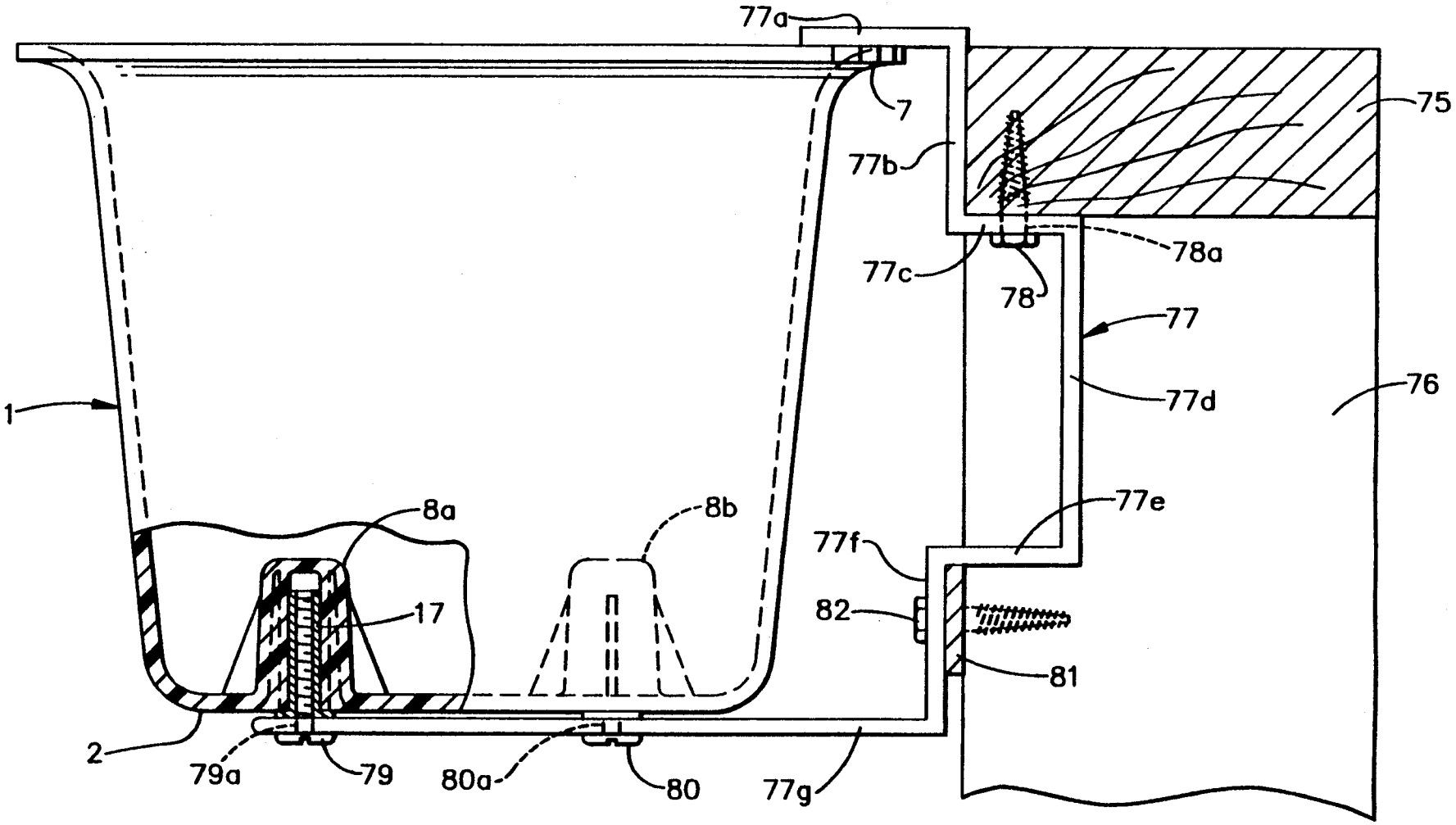
FIG. 18 is a fragmentary end elevational view, partly in cross-section, illustrating a simple bracket means for affixing the planter alongside the top rail of a railing.

FIG. 18 illustrates another bracket arrangement for supporting the planter 1 to one side of a deck or porch railing. For purposes of an exemplary showing, the railing is again illustrated as being of the type described with respect to FIG. 5. The 2"×4" top rail is indicated at 75 and one of the 2"×4" balusters is fragmentarily shown at 76.

The embodiment of FIG. 18 utilizes two identical brackets, one for each pair of sockets 8*a*–8*b* and 8*c*–8*d*. The bracket for sockets 8*a* and 8*b* is generally indicated at 77. The bracket 77 comprises a strap-like member made of appropriate material such as metal or plastic. The bracket 77 has a plurality of angularly related portions which will be described as viewed in FIG. 18. The first portion is indicated at 77*a*. The portion 77*a* is horizontally oriented and is adapted to overlie the adjacent portion of the upper lip 7 of planter 1. The portion 77*a* is followed by portion 77*b* which lies along one side of top rail 75. The portion 77*b* terminates in a portion 77*c* which is horizontal and underlies the bottom surface of top rail 75. Portion 77*c* terminates in portion 77*d* which extends vertically downwardly to horizontal portion 77*e*. It will be noted that the portion 77*e* is parallel to the portion 77*c*, being slightly longer for reasons which will be apparent hereinafter. The portion 77*e* terminates in a downwardly depending portion 77*f*. The portion 77*f* terminates in the final portion 77*g* of bracket 77. The portion 77*g* extends horizontally beneath the bottom 2 of planter 1.

The bracket 77 is affixed to top rail 75 by means of a wood screw 78 which passes through a perforation 78*a* in bracket portion 77*c* and upwardly into top rail 75. Bracket portion 77*g* is provided with a pair of perforations 79*a* and 80*a* coaxial with the bushings 17 of sockets 8*a* and 8*b* and adapted to receive headed bolts 79 and 80 which are threadedly engaged in the bushings 17.

A support bar 81 is provided. The support bar is of a length approximating the length of the planter 1. Support bar 81 is mounted horizontally against the balusters and is affixed to selected ones of the balusters by wood screws, one of which is shown at 82. The support bar 81 may be made of any appropriate material such as metal or plastic.

As indicated above, the portion 77*e* is slightly longer than the portion 77*c* of bracket 77. This enables the portion 77*e* to overlie support bar 81, with the portion 77*f* abutting the adjacent face of support bar 81.

It will be evident that the bracket (not shown), equivalent to bracket 77, for the socket pair 8*c*–8*d* will be similarly affixed to top rail 75 and will similarly engage support bar 81. The support bar 81 not only provides additional support for the mounting brackets, but also tends to cause the mounting brackets to maintain their proper shape despite the weight of planter 1 and its contents.

Figure 19:
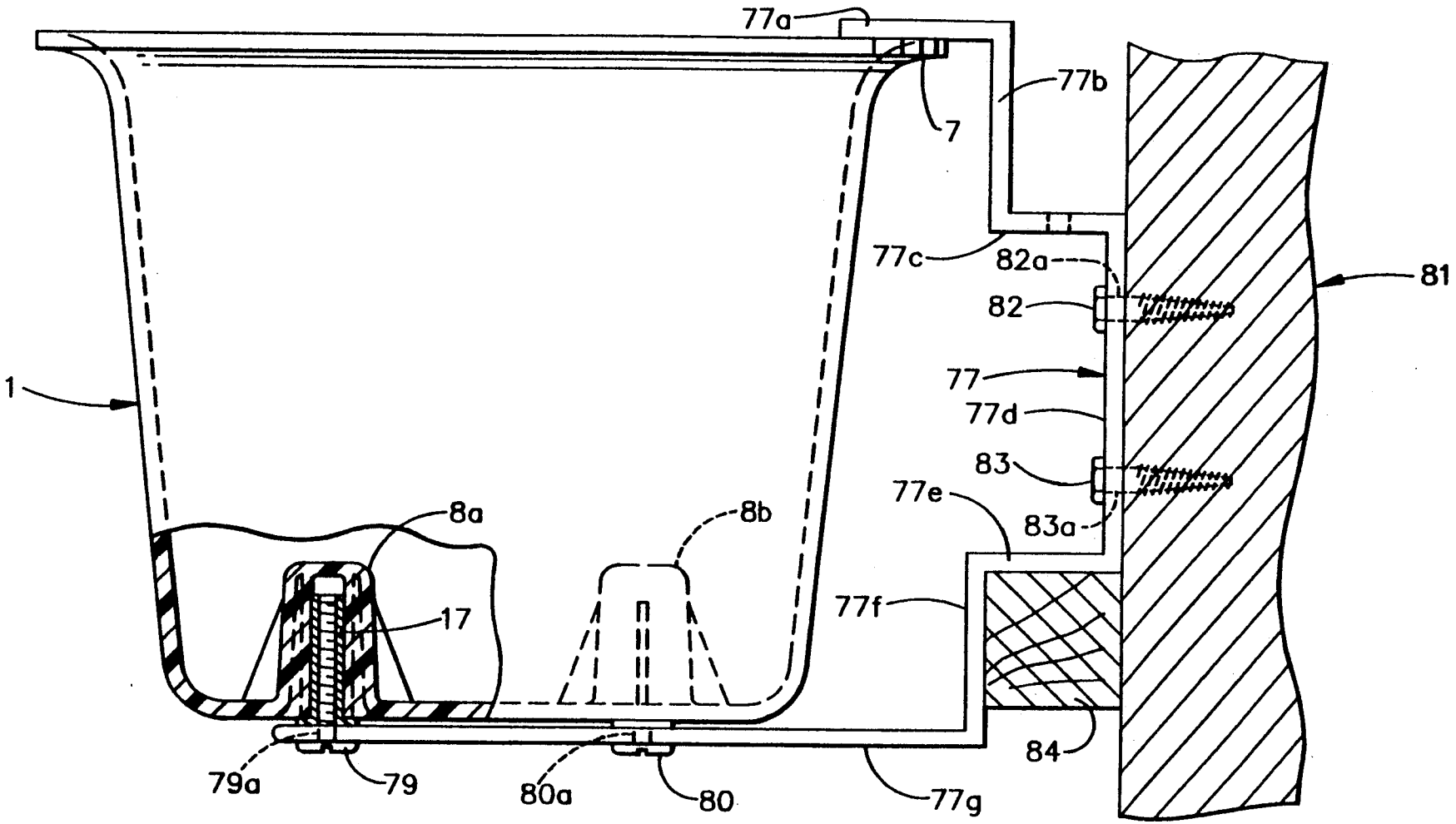
FIG. 19 is a fragmentary end elevational view, partly in cross-section, illustrating the use of the bracket of FIG. 18 to mount the planter on a wall.

FIG. 19 illustrates the bracket 77 as applied to any appropriate vertical wall. The wall is generally indicated at 81. The wall 81 could be made of any appropriate material such as wood, masonry, or the like. For purposes of an exemplary showing, the wall 81 is illustrated as being made of wood. The wall 81 could constitute a part of a solid railing, a divider wall, or even the siding of a house, the bracket 77 being used to mount the planter 1 beneath a window or the like.

As in the embodiment of FIG. 18, the uppermost horizontal portion 77*a* of bracket 77 overlies a portion of the peripheral flange 7 of planter 1. Bracket portion 77*g* underlies the bottom 2 of planter 1 and is attached to the planter by headed bolts 79 and 80 passing through perforations 79*a* and 80*a* in bracket portion 77*g* and threadedly engaged in the bushings 17 of sockets 8a and 8b. The vertical portion 77d of bracket 77 is affixed to wall 81 by a pair of wood screws 82 and 83 passing through perforations 82a and 83a, respectively, in bracket portion 77d It will be understood that a second bracket (not shown), identical to bracket 77, will be for the planter socket pair 8c–8d. The second bracket will be attached to the wall 8 in precisely the same manner and will similarly engage the planter 1.

The assembly is completed by the provision of an elongated wooden filler member 84. The filler member 84 is of such length that it will cooperate with both bracket 77 and its counterpart (not shown). The filler member 84 serves to maintain the shape of the brackets. The filler member 84 may be attached in any appropriate way to the wall 81, to the bracket 77, or both.

Figure 20:
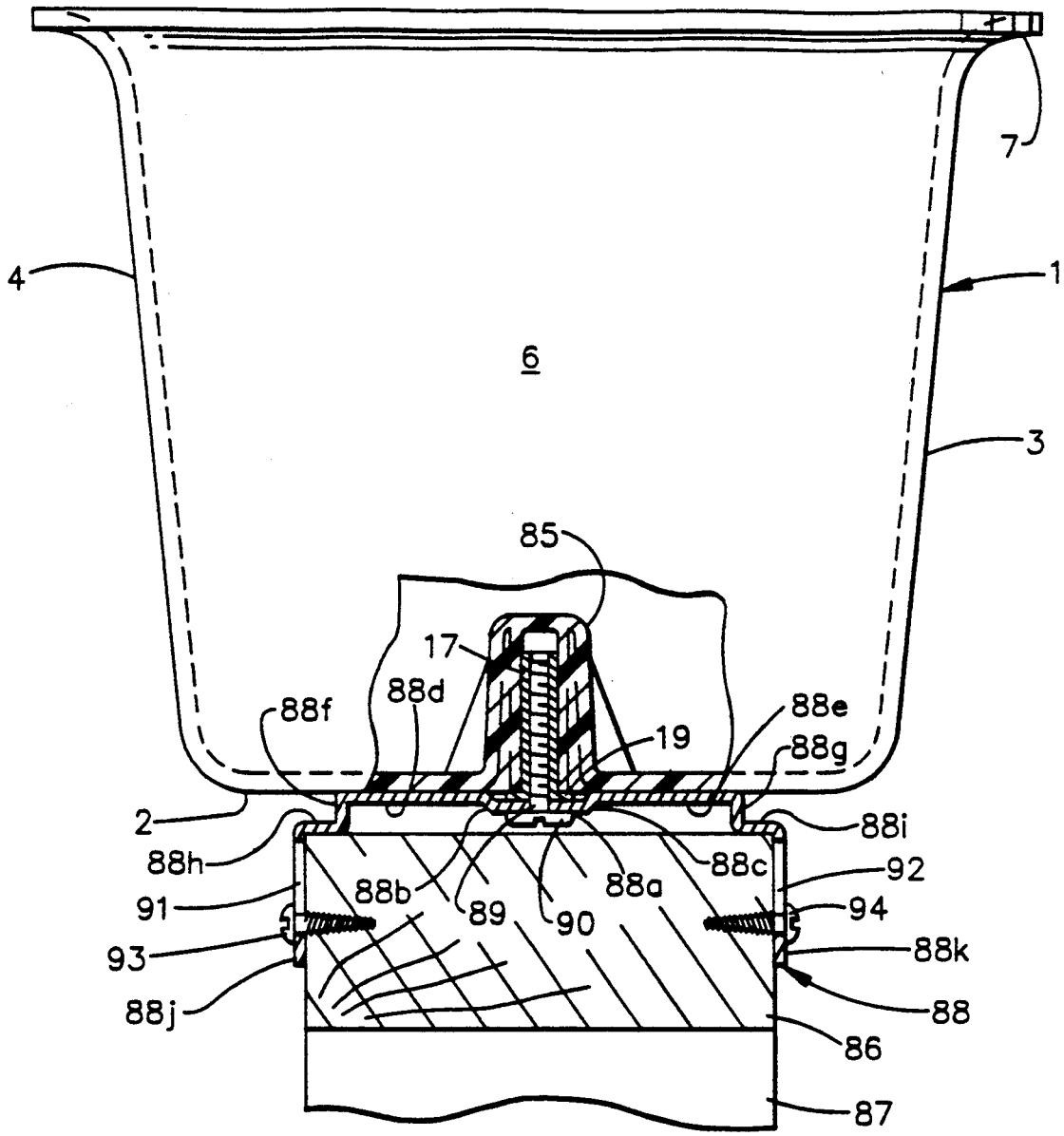
FIG. 20 is a fragmentary end elevational view, partly in cross-section, illustrating an embodiment requiring only two sockets formed in the planter bottom.

In all of the embodiments thus far described, the planter 1 was provided with two pairs of sockets 8a–8b and 8c–8d. FIG. 20 illustrates an embodiment wherein the planter 1 is provided with a single pair of sockets, one located near each end of the planter. Thus, a socket 85 is illustrated near the end wall 6 of the planter 1. The socket 85 is identical to the previously described sockets 8a through 8d, and contains an internally threaded bushing 17.

For purposes of an exemplary showing, FIG. 20 again illustrates the planter 1 mounted on a porch or deck railing of the type described with respect to FIG. 5. A 2"×4" top rail 86 is supported by a plurality of 2"×4" balusters, one of which is fragmentarily shown at 87.

The embodiment of FIG. 20 employs two identical brackets, one of which is generally indicated at 88. The bracket 88 has a central horizontal portion 88a which terminates in upwardly and outwardly sloping portions 88b and 88c. The portions 88b and 88c, in turn, terminate in horizontal portions 88d and 88e. Portions 88d and 88e lead to vertical portions 88f and 88g. The portions 88f and 88g terminate in horizontal portions 88h and 88i, which lead to vertical portions 88j and 88k.

The central bracket portion 88a has perforation 89 formed therein. The perforation 89 is adapted to receive a headed bolt 90 which is threadedly engaged in bushing 17 to affix the bracket 88 to the planter 1. The upwardly and outwardly extending bracket portions 88b and 88c are so sized that, together with the central portion 88a, they will accommodate the flange 19 of bushing 17. Bracket portions 88d and 88e lie along and support the bottom 2 of planter 1. The vertical portions 88f and 88g are so sized as to enable the bracket to accommodate the head of bolt 90. The horizontal portions 88h and 88i lie along the upper surface of top rail 86. Finally, the downwardly depending portions 88j and 88k are parallel to each other and so spaced from each other as to just nicely receive the top rail 86 therebetween. The vertical portions 88j and 88k are provided with centered vertical slots 91 and 92 respectively. A pair of wood screws 93 and 94 pass through the slots 91 and 92, fastening the bracket 88 to the sides of top rail 86.

It will be understood that the socket (not shown) equivalent to socket 85 and located near the other end of planter 1 will be provided with a bracket (not shown) identical to bracket 88. The second bracket will be affixed to the planter 1 and to the top rail 86 in precisely the same manner. When both brackets are so mounted, the planter 1 will be firmly and safely affixed to top rail 86.

Figure 21:
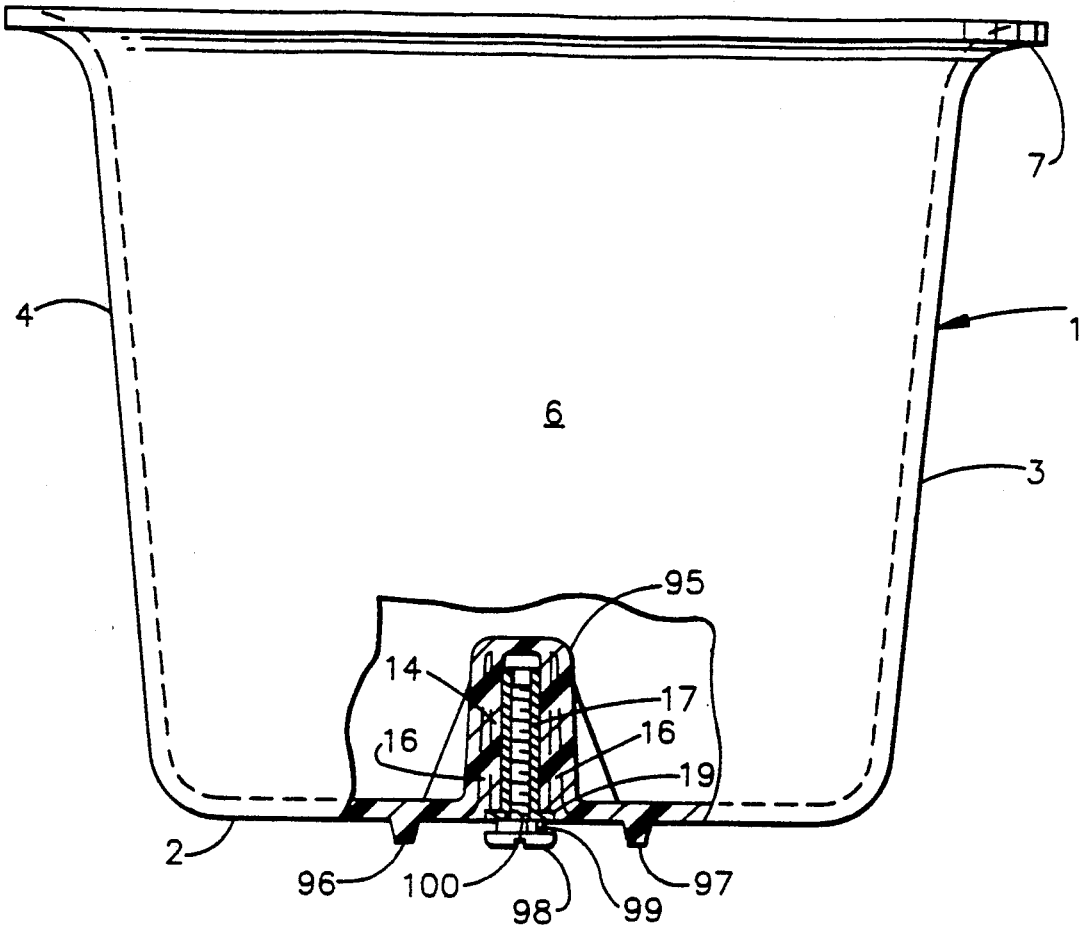
FIG. 21 is an end elevational view, partly in cross-section, of a planter having a single central socket
Figure 22:
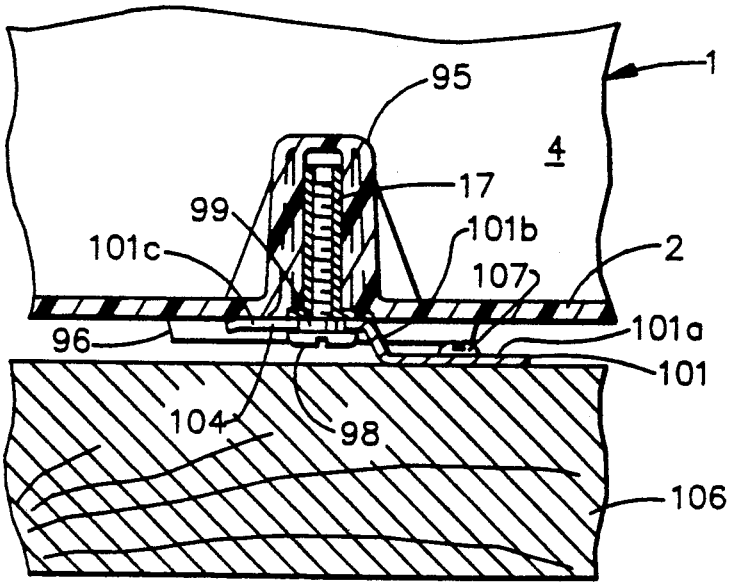
FIG. 22 is a fragmentary side elevational view, in cross-section, of the embodiment of FIG. 21.
Figure 23:
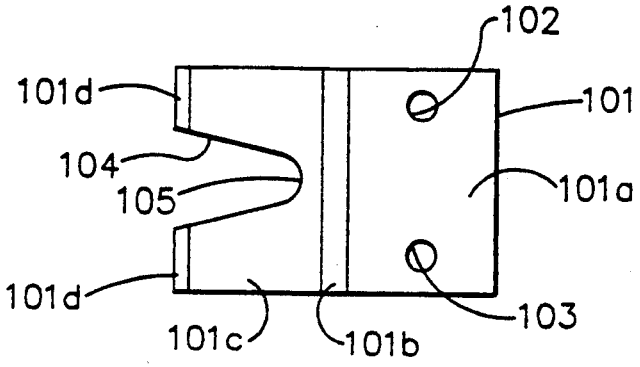
FIG. 23 is a plan view of the bracket illustrated in FIG. 22.

The embodiment illustrated in FIGS. 21–23 requires the planter 1 to have a single socket 95 located at the longitudinal and transverse center of planter bottom 2. The socket 95 is substantially identical to the previously described sockets and is provided with an internally threaded bushing 17. In this embodiment the planter 1 is provided with a pair of integral guide rails 96 and 97. Guide rails 96 and 97 are relatively short (see FIG. 22) and extend longitudinally of the planter bottom 2. The guide rails 96 and 97 are parallel and are located to either side of socket 95. The purpose of guide rails 96 and 97 will be apparent hereinafter.

As is clearly shown in FIG. 21, the outermost edges of the cylindrical member 14 and webs 16 of socket 95 are slightly recessed so that the flange 19 of internally threaded bushing 17 is flush with the bottom 2 of planter on. The bushing 17 is adapted to receive a headed bolt 98. The bolt 98, adjacent its head, has an enlarged diameter shank portion, forming an annular shoulder at 100. When the bolt is threadedly engaged in bushing 17, the annular shoulder 100 abuts the flange 19 of bushing 17, as shown in FIG. 21. Thus, the enlarged shank portion 100 and the head of bolt 19 constitute a headed stand-off extending downwardly from the planter bottom 2.

The embodiment of FIGS. 21 through 23 employs a single bracket 101, which is clearly shown in FIG. 23. The bracket 101 has a first planar portion 101a provided with perforations 102 and 103. The portion 101a terminates in an upwardly and forwardly sloping portion 101b. The portion 101b, in turn, terminates in a planar tongue portion 101c. The portion 101c is parallel to the portion 101a. The free forward edge of portion 101c is slightly downturned (see FIG. 22), as indicated at 101d. The bracket 101 is completed by the provision of a generally v-shaped slot 104 formed in the bracket portion 101c. The slot 104 has a rounded end 105 of a diameter approximating the diameter of the enlarged shank portion 99 of bolt 98.

The bracket 101 is affixed to any appropriate horizontal surface by appropriate fastening means passing through the bracket perforations 102 and 103. In FIG. 22, for purposes of an exemplary showing, the bracket 101 is illustrated as being mounted on the horizontal top surface of the top rail 106 of a porch or deck railing. This is accomplished by a pair of wood screws, one of which is shown at 107. It will be apparent from FIG. 22 that the bracket portion 101b is so sized that bracket portion 101c is elevated from the top surface of top rail 106 by a distance sufficient to accommodate the head of bolt 98.

The bracket 101 is affixed to the top surface of top rail 106 in such a manner that it extends longitudinally thereof and is centered between the longitudinal edges of the top rail. When the bracket 101 is in place, the planter 1 is located thereover with the bolt 98 to the left of bracket portion 101c (as viewed in FIG. 22). The planter is then shifted to the right (as viewed in FIG. 22) causing the portion 101c of bracket 101 to enter between the guide rails 96 and 97. The shifting of planter 1 to the right (as viewed in FIG. 22) is continued until the enlarged shank portion 99 of bolt 98 is received by and abuts the rounded portion 105 of slot 104. In this way, the bolt 98 is firmly engaged by bracket portion 101c and the planter 1 is firmly mounted on the upper surface of top rail 106. The guide rails 96 and 97 are spaced from each other by a distance substantially equal to the width of bracket 101. As a result, the guide rails assist in guiding the bolt 98 into engagement with the slot 104 of bracket portion 101*c*. Furthermore, when the bolt 98 is fully engaged by bracket 101, the rails 96 and 97 will preclude rotation of the planter 1 about the bolt 98. The result is an easy, simple, safe and firm attachment of the planter to the top surface of top rail 106. To remove the planter from the top rail 106, it is only necessary to shift the planter to the left (as viewed in FIG. 22) until bolt 98 is no longer engaged by bracket 101.

In the embodiment of FIGS. 21, 22 and 23 it would be within the spirit of the invention to add a downwardly depending foot near each corner of the bottom 2 of the planter. Two such feet are shown in phantom at 108 and 109 in FIG. 21. The feet are slightly longer than the rails 96 and 97 and are adapted to contact the upper surface of top rail 106 to further stabilize the planter 1. The elements 108 and 109 of FIG. 21 could also be thought of as rails extending longitudinally of planter 1 and serving the same purpose.

Figure 24:
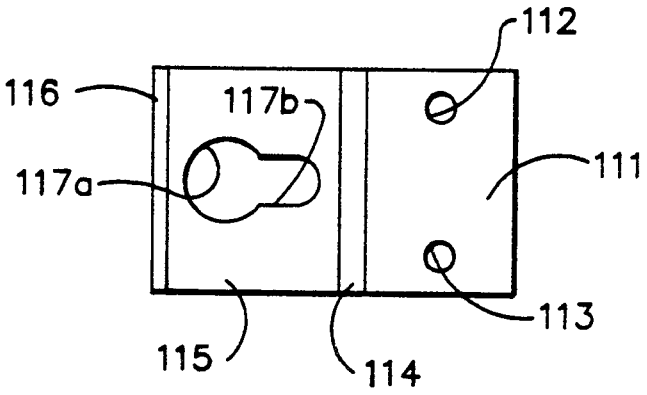
FIG. 24 is a plan view of a bracket similar to that of FIG. 23, but provided with a keyhole slot.

FIG. 24 illustrates a modification of the bracket 23. In FIG. 24 the bracket 110 is substantially identical to bracket 101 having a mounting portion 111 with perforations 112 and 113 therein, an upwardly and forwardly extending portion 114, and a tongue portion 115, the leading edge 116 of which may be bent slightly downwardly. The only difference between the bracket 111 and the bracket 101 lies in the fact that the slot 104–105 of bracket 101 has been replaced by a keyhole slot 117. The keyhole slot 117 has a fist portion 117*a* of such size as to allow the head of bolt 98 to pass therethrough. The keyhole slot 117 has a second elongated portion 117*b* having a width less than the diameter of the head of bolt 98 but just wide enough to accommodate the enlarged shank portion 99 thereof.

In this instance, the head of bolt 98 and its enlarged shank portion 99 again act as a headed stand-off. To mount planter 1 on top rail 106, the planter is so located that the head of bolt 98 passes through keyhole slot portion 117*a*. The planter is then shifted longitudinally to cause the enlarged shank portion 99 of bolt 98 to enter keyhole slot portion 117*b* to firmly affix the planter 1 to the top surface of top rail 106. Again, the ribs 96 and 97 on the bottom 2 of planter 1 cooperate with the sides of tongue portion 115 of bracket 110 to preclude rotation of the planter 1 about the enlarged diameter shank portion 99 of headed bolt 98.

The headed stand-off, instead of comprising parts of bolt 98, could constitute an integral, one-piece molded part of planter 1, thus eliminating the need for socket 85 and bushing 17. Alternatively, the headed stand-off could constitute a separate metallic member provided with a short shank so sized as to be received in the bore 14 of socket 85 and to be sonically welded therein. In such an instance, no bushing is required, and the exterior surface of the short shank would preferably be roughened as by knurling or the like.

It would be within the scope of the invention to mount a stand-off on the top surface of top rail 106 and provide the bottom 2 of planter 1 with a keyhole slot as an integral part thereof or in the form of a bracket attachable to planter bottom 2 and having the keyhole slot formed therein.

Finally, it would be possible to provide the planter 1 with a stand-off and bracket (having an open ended slot or a keyhole slot) near each end wall thereof, similar to the embodiment of FIGS. 13, 14 and 15. In such an instance, the guide rails 96 and 97 of FIG. 21 could be eliminated.

Modifications may be made in the invention without departing from the spirit of it.

What is claimed is:

1. A planter and mounting assembly therefor for affixing said planter to a horizontal or vertical mounting surface, said planter comprising a bottom having a bottom surface, a surrounding wall extending upwardly from said bottom having an upper edge defining an open top, at least one headed bolt, at least one bushing extending vertically upwardly from the bottom surface of said planter bottom within said planter, said at least one bushing having an internally threaded bore adapted to receive said at least one headed bolt, means isolating said headed bolt from the interior of said planter, at least one bracket, said at least one bracket being attachable to said planter by said at least one headed bolt, and means to attach said at least one bracket to said horizontal or vertical mounting surface.

2. The planter and mounting assembly therefor claimed in claim 1 wherein said planter comprises an elongated structure, said bottom being rectangular and said surrounding wall comprises a pair of side walls and a pair of end walls.

3. The planter and mounting assembly therefor claimed in claim 1 wherein said planter comprises an integral, one-piece structure molded of appropriate plastic or synthetic resin material.

4. The planter and mounting assembly therefor claimed in claim 2 including two pairs of said bushings, said bushings being inset from the corners of said rectangular planter bottom so that each bushing pair is located near one of said planter end walls.

5. The planter and mounting assembly therefor claimed in claim 2 including a pair of said bushings, each bushing of said pair being located at the longitudinal centerline of said planter bottom near one of said planter end walls.

6. The planter and mounting means therefor claimed in claim 2 including a single bushing located at the intersection of the longitudinal and transverse centerlines of said bottom surface of said planter bottom.

7. The planter and mounting assembly therefor claimed in claim 3 including at least one integral, one-piece, upstanding socket molded in said planter bottom, said at least one socket having a vertically oriented central bore open at its lower end and closed at its upper end, said at least one bushing being located in said socket bore and means to maintain said bushing therein.

8. The planter and mounting assembly therefor claimed in claim 4 wherein said mounting surface is horizontal, said mounting assembly comprises a first and a second bracket for each pair of bushings, each first bracket comprises an elongated member having a planar central portion terminating in upwardly and outwardly extending intermediate portions, said intermediate portions terminating in end portions which are coplanar and are parallel to and vertically offset from said central portion, each of said first brackets is affixed to said bottom of said planter by headed bolts passing through perforations in said bracket end portions and threadedly engaged in said bushings of its respective bushing pair, each of said second brackets comprising a first planar mounting portion terminating at one end in an upwardly and forwardly sloping intermediate portion, said intermediate portion terminating in a planar tongue portion parallel to said mounting portion and offset vertically therefrom, said second brackets being affixed to said mounting surface by fastening means extending through perforations in their mounting portions and into said mounting surface, said second brackets being aligned one behind the other with their tongue portions extending in the same direction, said tongue portions of said second brackets having a width approximating the length of said central portions of said first brackets, said tongue portions of said second brackets being parallel to said mounting surface and spaced upwardly therefrom by said second bracket intermediate portions by a distance at least equal to the thickness of said central portions of said first brackets, said planter being locatable on said mounting surface and supported thereon by said central portions of said first brackets, said second brackets being so spaced from each other than said first brackets can be simultaneously located adjacent said second bracket tongue portions, said planter being shiftable longitudinally in a first direction to cause said first bracket central portions to slip beneath said second bracket tongue portions to fix said planter to said mounting surface, said planter being shiftable in a second opposite direction to remove said first bracket central portions from beneath said second bracket tongue portions to release said planter from said mounting surface.

9. The planter and mounting assembly therefor claimed in claim 4 wherein said mounting surface comprises the top surface of the top rail of a railing, said top rail being supported by a plurality of balusters, said top rail having a rectangular cross-section with horizontal top and bottom surfaces and vertical side surfaces, said top and bottom surfaces being of greater transverse dimensions than said side surfaces, said mounting assembly comprising an angle bracket for each bushing of said planter, said angle brackets being identical, each angle bracket comprising a first leg and a second leg, said first leg being longer than said second leg, said first and second legs having first ends joined together at an angle of 90° and second free ends, said first and second legs each having a centered longitudinally extending slot formed therein, each of said angle brackets being affixed to said planter bottom by a headed bolt passing through said slot in its first leg and threadedly engaged in one of said bushings, said brackets of each bushing pair being so oriented that their first leg free ends face each other and their second legs lie along said top rail sides, said brackets being affixed to said top rail by fastener means passing through said second leg slots and into said top rail sides.

10. The planter and mounting assembly therefor claimed in claim 4 wherein said mounting surface comprises the top surface of the top rail of a railing, said top rail being supported by a plurality of balusters, said top rail having a rectangular cross-section with horizontal top and bottom surfaces and vertical side surfaces, said top and bottom surfaces being of lesser transverse dimensions than said side surfaces, said mounting assembly comprising an angle bracket for each bushing of said planter, said angle brackets being identical, each angle bracket comprising a first leg and a second leg, said first leg being longer than said second leg, said first and second legs having first ends joined together at an angle of 90° and second free ends, said first and second legs each having a centered longitudinally extending slot formed therein, each of said angle brackets being affixed to said planter bottom by a headed bolt passing through said slot in its second leg and threadedly engaged in one of said bushings, said brackets of each bushing pair being so oriented that said free ends of said second legs face in opposite directions and said first legs lie along said top rail sides, said brackets being affixed to said top rail by fastener means passing through said first leg slots and into said top rail sides.

11. The planter and mounting assembly therefor claimed in claim 4 wherein said mounting surface comprises the top surface of the top rail of a metal railing, said top rail being supported by a plurality of balusters, said top railing having a substantially rectangular cross-section with horizontal top and bottom surfaces, said mounting assembly comprising an elongated, planar, plate-like bracket for each of said pairs of bushings, each bracket having a perforation near each of its ends, the perforations of each bracket being spaced from each other by a distance equal to the distance between the threaded bores of the bushings of its respective pair thereof, a pair of headed bolts for each of said brackets, said planter being locatable on said top surface of said top rail with said top rail being located between the bushings of each pair thereof, each of said brackets being locatable beneath said top rail and extending transversely thereof, each bracket being attachable to said planter by its respective pair of headed bolts passing through said perforations in said bracket and threadedly engaged in its respective pair of bushings, whereby said planter is affixed to said top surface of said top rail when said bolts are tightened by the clamping of said top rail between said planter bottom and said bracket.

12. The planter and mounting assembly therefor claimed in claim 4 wherein said mounting surface comprises the top surface of the top rail of a metal railing, said top rail being supported by a plurality of balusters, said top railing having a substantially channel shaped cross-section with a horizontal top portion and downwardly depending leg portions, said mounting assembly comprising an elongated, planar, plate-like bracket for each of said pairs of bushings, each bracket having a perforation near each of its ends, the perforations of each bracket being spaced from each other by a distance equal to the distance between the threaded bores of the bushings of its respective pair thereof, a pair of headed bolts for each of said brackets, said planter being locatable on said top surface of said top rail with said top rail being located between the bushings of each pair thereof, each of said brackets being locatable beneath said top rail and extending transversely thereof, each bracket being attachable to said planter by its respective pair of headed bolts passing through said perforations in said bracket and threadedly engaged in its respective pair of bushings, whereby said planter is affixed to said top of said top rail when said bolts are tightened by the clamping of said top rail between said planter bottom and said bracket.

13. The planter and mounting assembly therefor claimed in claim 4 including a wooden railing comprising a wooden top rail supported by a plurality of balusters, said wooden top rail having a rectangular cross section with horizontal top and bottom surfaces and vertical side surfaces, said mounting surface comprising one of said vertical top rail side surfaces, said mounting assembly comprising first and second brackets for each bushing pair, said first brackets being identical and said second brackets being identical, each of said first brackets comprising an angle bracket having first and second legs joined together at an angle of 90°, said first leg of each first bracket being oriented vertically and attached to said mounting surface by a screw passing through a perforation therein and into said mounting surface, said second leg of each first bracket being horizontally oriented and underlying one of said pairs of bushings and being attached to at least one of said bushings of its respective pair by a bolt passing through a perforation in said second leg and threadedly engaged in said at least one bushing, each of said second brackets comprising an angle bracket having first and second legs joined together at an angle of 90°, said first leg of each of said second brackets being horizontally oriented and being affixed to the bottom surface of said top rail by at least one screw passing through at least one perforation therein and into said bottom surface of said top rail, said second leg of each of said second brackets being vertically oriented and lying along said first leg of one of said first brackets and affixed thereto by a bolt passing through coaxial perforations in said last mentioned legs.

14. The planter and mounting assembly therefor claimed in claim 4 including a wooden railing comprising a wooden top rail supported by a plurality of balusters, said wooden top rail having a rectangular cross section with horizontal top and bottom surfaces and vertical side surfaces, said mounting assembly comprising a bracket for each bushing pair, said brackets being identical, each bracket being formed from an elongated strip-like metallic member, each bracket comprising a first horizontal portion extending laterally from one of said top rail side surfaces, said first horizontal portion having a bottom portion substantially coplanar with said top surface of said top rail, said first horizontal portion terminating in a first downwardly directed vertical portion extending transversely of and abutting said one of said top rail side surfaces, said first vertical bracket portion terminating in a second horizontal portion extending part way across said top rail bottom surface and affixed thereto by a screw passing through a perforation therein and into said top rail bottom surface, said second horizontal portion terminating in a second downwardly directed vertical portion, said second vertical portion terminating in a third horizontal portion extending in the same direction as said first horizontal portion, said third horizontal portion terminating in a downwardly directed third vertical portion ending in a fourth horizontal portion extending in the same direction as said first horizontal portion, a horizontal support rail affixed to said balusters, said third horizontal portion of each of said brackets resting on said support bar, said third vertical portion of each bracket abutting said support bar, said planter being mounted on said brackets with said fourth horizontal portions of each bracket underlying said planter bottom and said bushing pairs thereof, each of said fourth horizontal bracket portions being affixed to at least on of said bushings of its respective pair by at least one bolt passing through a perforation therein and threadedly engaged in said at least one bushing, said first horizontal portions of said brackets overlying and engaging adjacent portions of said upper edge of said planter surrounding wall.

15. The planter and mounting assembly therefor claimed in claim 4 wherein said mounting surface comprises a vertical wall, said mounting assembly comprising a bracket for each bushing pair, said brackets being identical, each bracket being formed from an elongated strip-like metallic member, each bracket comprising a first horizontal portion extending away from said mounting surface, said first horizontal portion terminating in a first downwardly directed vertical portion, said first vertical bracket portion terminating in a second horizontal portion extending toward said mounting surface said second horizontal portion terminating in a second downwardly directed vertical portion lying along said mounting surface and affixed thereto by at least one fastener extending through at least one perforation in said second vertical bracket portion and into said mounting surface, said second vertical portion terminating in a third horizontal portion extending away from said mounting surface, said third horizontal portion terminating in a downwardly directed third vertical portion ending in a fourth horizontal portion extending away from said mounting surface, a horizontal filler fail of rectangular cross-section affixed to said mounting surface, said third horizontal portion of each of said brackets resting on said filler rail, said third vertical portion of each bracket abutting said filler rail, said planter being mounted on said brackets with said fourth horizontal portion of said brackets underlying said planter bottom and said bushing pairs thereof, each of said fourth horizontal bracket portions being affixed to at least one of said bushings of its respective pair by at least one bolt passing through a perforation therein and threadedly engaged in said at least one bushing, said first horizontal portion of said brackets overlying and engaging adjacent portions of said upper edge of said planter surrounding wall.

16. The planter and mounting assembly therefor claimed in claim 5 wherein said mounting surface comprises the top surface of the top rail of a railing, said top rail being supported by a plurality of balusters, said top rail having a rectangular cross-section with horizontal top and bottom surfaces and vertical side surfaces, said mounting assembly comprising a bracket for each of said bushings, said brackets being identical, each bracket comprising a horizontal central portion underlying said planter bottom and its respective one of said bushings, said central portion having a central perforation, a headed bolt passing through said perforation and threadedly engaged in said last mentioned bushing to affix said bracket to said planter, said central portion of each bracket terminating in downwardly depending portions, each terminating in outwardly directed horizontal portions overlying said horizontal top surface of said top rail, said outwardly directed horizontal bracket portions terminating in downwardly depending portions each having a central longitudinal slot therein and each lying along one of said vertical side surfaces of said top rail, each of said brackets being affixed to said top rail by fastener means passing through said slotted portions thereof and into said top rail sides.

17. The planter and mounting assembly therefor claimed in claim 5 wherein said mounting surface comprises a horizontal surface, said mounting assembly comprises a bolt for each bushing of said pair, each bolt comprising a first threaded shank portion, a second shank portion of greater diameter than said first shank portion and forming an annular shoulder therebetween and a head of greater diameter than said second shank portion, each of said bolts being threadedly engaged in its respective bushing with its shoulder abutting said open bushing end so that said second shank portion and said head extend below said planter bottom and constitute a standoff, a bracket for each bushing, each bracket comprising a first planar mounting portion terminating at one end in an upwardly and forwardly sloping intermediate portion, said intermediate portion terminating in a planar tongue portion parallel to said mounting portion and offset vertically therefrom by a distance at least equal to the thickness of said bolt head, each of said brackets being affixed to said mounting surface by fastening means extending through perforations in its mounting portion and into said mounting surface, said second brackets being aligned one behind the other with their tongue portions extending in the same direction, the tongue portions of each of said brackets having a longitudinal slot formed therein, said standoffs of said planter being simultaneously engagable in said slots to affix said planter to said mounting surface.

18. The planter and mounting assembly therefor claimed in claim 6 wherein said mounting surface comprises a horizontal surface, said mounting assembly comprises a bolt for said bushing, said bolt comprising a first threaded shank portion, a second shank portion of greater diameter than said first shank portion and forming an annular shoulder therebetween and a head of greater diameter than said second shank portion, said bolt being threadedly engaged in said bushing with its shoulder abutting said open bushing end so that said second shank portion and said head extend below said planter bottom and constitute a standoff, a bracket for said bushing, said bracket comprising a first planar mounting portion terminating at one end in an upwardly and forwardly sloping intermediate portion, said intermediate portion terminating in a planar tongue portion parallel to said mounting portion and offset vertically therefrom by a distance at least equal to the thickness of said bolt head, said bracket being affixed to said mounting surface by fastening means extending through perforations in its mounting portion and into said mounting surface, the tongue portion of said bracket having a longitudinal slot formed therein, said standoff of said planter being engagable in said slot to affix said planter to said mounting surface, a pair of longitudinally extending guide rails on said planter bottom to either side of said standoff, said rails being parallel and spaced from each other by a distance equal to the width of said bracket tongue portion, said guide rails being adjacent the sides of said tongue portion of said bracket when said planter is mounted on said mounting surface whereby said guide rails will preclude rotation of said planter about said standoff.

19. The planter and mounting means therefor claimed in claim 4 wherein said planter comprises an integral one-piece structure molded of appropriate plastic or synthetic material, an integral one-piece, upstanding socket molded in said planter bottom for each bushing, each socket having a vertically oriented central bore open at its lower end and closed at its upper end, each bushing being located in said central bore of its respective socket and means to maintain each bushing in its respective socket bore.

20. The planter and mounting means therefor claimed in claim 5 wherein said planter comprises an integral one-piece structure molded of appropriate plastic or synthetic material, an integral one-piece, upstanding socket molded in said planter bottom, said socket having a vertically oriented central bore open at its lower end and closed at its upper end, said bushing being located in said central bore of said socket and means to maintain said bushing in said socket bore.

21. The planter and mounting means therefor claimed in claim 6 wherein said planter comprises an integral one-piece structure molded of appropriate plastic or synthetic material, an integral one-piece, upstanding socket molded in said planter bottom, said socket having a vertically oriented central bore open at its lower end and closed at its upper end, said bushing being located in said central bore of said socket and means to maintain said bushing in said socket bore.

22. The planter and mounting means therefor claimed in claim 8 wherein said mounting surface comprises the upper surface of the top rail of a railing.

23. The planter and mounting means therefor claimed in claim 17 wherein said mounting surface comprises the upper surface of the top rail of a railing.

24. The planter and mounting means therefor claimed in claim 17 wherein said bracket tongue portion has a leading edge, said slot extending from and inwardly of said leading edge.

25. The planter and mounting means therefor claimed in claim 17 wherein said slot comprises a keyhole slot.

26. The planter and mounting means therefor claimed in claim 18 wherein said bracket tongue portion has a leading edge, said slot extending from and inwardly of said leading edge.

27. The planter and mounting means therefor claimed in claim 18 wherein said slot comprises a keyhole slot.

* * * * *